US010684091B2

(12) United States Patent
Scarr

(10) Patent No.: US 10,684,091 B2
(45) Date of Patent: Jun. 16, 2020

(54) COMPRESSED GAS PERSONAL PROTECTION DEVICE

(71) Applicant: Scarr Research and Development Co. LLC, Richmond, IN (US)

(72) Inventor: Kimball Rustin Scarr, Richmond, IN (US)

(73) Assignee: Scarr Research and Development Co., LLC, Richmond, IN (US)

( * ) Notice: Subject to any disclaimer, the term of this patent is extended or adjusted under 35 U.S.C. 154(b) by 0 days.

(21) Appl. No.: 15/797,590

(22) Filed: Oct. 30, 2017

(65) Prior Publication Data

US 2018/0172393 A1 Jun. 21, 2018

Related U.S. Application Data

(63) Continuation of application No. 14/213,685, filed on Mar. 14, 2014, now Pat. No. 9,803,954.

(60) Provisional application No. 61/785,041, filed on Mar. 14, 2013.

(51) Int. Cl.

| | |
|---|---|
| ***F41B 11/73*** | (2013.01) |
| ***F41B 11/80*** | (2013.01) |
| ***F41B 11/62*** | (2013.01) |
| *F42B 6/10* | (2006.01) |
| *F42B 10/36* | (2006.01) |

(52) U.S. Cl.

CPC ..... *F41B 11/73* (2013.01); *F41B 11/62* (2013.01); *F41B 11/80* (2013.01); *F42B 6/10* (2013.01); *F42B 10/36* (2013.01)

(58) Field of Classification Search

CPC ..... F41B 11/00; F41B 11/72; F41B 11/73; F41B 11/80; A22B 3/00; A22B 3/02; F41C 27/00; F41C 3/02

USPC ..... 124/71–77; 452/57, 62; 42/106, 1.12

See application file for complete search history.

(56) References Cited

U.S. PATENT DOCUMENTS

| | | | |
|---|---|---|---|
| 2,572,176 | A | 10/1951 | Mihalyi |
| 2,723,656 | A | 11/1955 | Andina |
| 2,908,244 | A | 10/1959 | Clark |
| 3,420,220 | A | 1/1969 | Fernando |
| 4,936,282 | A | 6/1990 | Dobbins |
| 5,187,323 | A | 2/1993 | Saxby |
| 5,613,483 | A | 3/1997 | Lukas |
| 6,470,872 | B1 | 10/2002 | Tiberius |
| 7,044,119 | B2 | 5/2006 | Jones |
| 7,290,537 | B2 | 11/2007 | Yeh |
| 7,461,646 | B2 | 12/2008 | Jones |
| 7,556,032 | B2 | 7/2009 | Jones |
| 7,591,262 | B2 | 9/2009 | Jones |
| 7,594,505 | B2 | 9/2009 | Gan |
| 7,882,830 | B1 | 2/2011 | Gabrel |
| 8,690,020 | B1 | 4/2014 | Murray |

(Continued)

*Primary Examiner* — Jonathan C Weber

(74) *Attorney, Agent, or Firm* — John V. Daniluck; Dentons Bingham Greenebaum LLP

(57) ABSTRACT

A hand carryable, non-lethal personal protection device using compressed gas for operation. In some embodiments the device uses the compressed gas to create and shoot a vortex of air at the target. In other embodiments, the compressed gas can be used to shoot a burst of atomized water at the attacker. In still other embodiments the device uses the compressed gas to shoot ammunition, such as a ring airfoil, O-ring, bean bag, or other non-lethal blunt trauma munitions at the target. In still further embodiments, the device is modular in its construction, and can be used to apply the compressed gas to various different attachments.

13 Claims, 41 Drawing Sheets

(56) References Cited

U.S. PATENT DOCUMENTS

| | | | |
|---|---|---|---|
| 2003/0168052 | A1 | 9/2003 | Masse |
| 2005/0115554 | A1 | 6/2005 | Jones |
| 2006/0011186 | A1 | 1/2006 | Jones |
| 2006/0011187 | A1 | 1/2006 | Jones |
| 2006/0011188 | A1 | 1/2006 | Jones |
| 2006/0124118 | A1 | 6/2006 | Dobbins |
| 2006/0162716 | A1 | 7/2006 | Dobbins |
| 2007/0068502 | A1 | 3/2007 | Jones |
| 2007/0209650 | A1 | 9/2007 | Jones |
| 2011/0088675 | A1 | 4/2011 | Wood |

84

COMPRESSED GAS PERSONAL PROTECTION DEVICE

CROSS REFERENCE TO RELATED APPLICATIONS

This application is a continuation of U.S. patent application Ser. No. 14/213,685, filed Mar. 14, 2014, now issued as U.S. Pat. No. 9,803,954, which claims the benefit of priority to U.S. Provisional Patent Application Ser. No. 61/785,041, filed Mar. 14, 2013, both incorporated herein by reference.

FIELD OF THE INVENTION

Various embodiments of the present invention pertain to methods and apparatus for actuatable pressure vessels, and in some embodiments to pressure vessels used with non-lethal weapons.

BACKGROUND OF THE INVENTION

Traditional and practical non-lethal weapon technology has grown out of conventional small arms ammunition technology. This outgrowth has resulted in development of projectiles and technology that prevents penetration similar to what happens with a bulletproof vest and conventional lethal penetration ammunition. Using a blunt or padded or cushioned projectile to impact the target produces a deterrent pain response without penetration injury. This functions by the contract pressure of impact creating a pain response in the nervous system. These are traditionally called "Blunt Impact Technologies": Blunt impact is used to describe the effect produced by existing rudimentary munitions such as rubber bullets, sting balls and bean bag rounds as well as more sophisticated non-lethal munitions carrying other payloads.

While generally effective, blunt impact technologies are limited in range and often have a higher risk of injury as compared to other stimuli. The worldwide development efforts of militaries and police forces research and development organizations are now focused on exploring alternative methods to deliver blunt impact effects at long ranges while minimizing the risk of injury at short ranges.

Non-lethal projectiles must meet a variety of conflicting requirements. They should be fired from existing weapons to prevent the people interested in self-defense, police and warfighters from carrying additional load and to prevent the need for additional weapons procurement. They should provide the desired affect at a variety of ranges. They should be lightweight to lower the burden on the user of carrying this additional capability. Above all they should be non-lethal at all distances, even near the exit the muzzle.

Existing projectile based Blunt Impact Technologies, such as beanbag rounds; rubber bullets and sponge rounds that rely on mass and velocity to create the desired effect are unable to meet these varied requirements. The problem is that the size and shape of these projectiles necessitate a relatively high initial velocity and/or mass in order to travel to the effective range. This high initial velocity combined with their mass in excess of 15 grams creates deep tissue injuries and may cause death or serious injury at short ranges. Usually even the best and lightest have masses of 30 g or more with frontal cross sectional density of 2.4 g/cm$^2$. The lack of aerodynamics of these blunt trauma solutions cause them to be ineffective at ranges in excess of 50 meters. Lighter rounds have been developed for pistols and shotguns, but these rounds even more so lack range.

What is needed are improvements to the technology of non-lethal weapons. The inventions described herein do this in novel and unobvious ways. As used herein, the term "non-lethal" refers to weapons that are designed and/or operated so as to greatly reduce the probability of the discharge of the weapon either killing a person or creating permanent injury to an average person. Because of the wide range of operational uses, ambient conditions, and characteristics of the target, it is not possible for the devices disclosed herein to be non-lethal all of the time. It is understood that the use herein of the term "non-lethal" is inaccurate for these reasons, and the weapons disclosed herein are better described as "less-lethal."

SUMMARY OF THE INVENTION

It will be appreciated that the various apparatus and methods described in this application can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions. Further, some of the figures shown herein may have been created from scaled drawings or from photographs that are scalable. It is understood that such dimensions, or the relative scaling within a figure, are by way of example, and not to be construed as limiting.

ELEMENT NUMBERING

Figure 1:
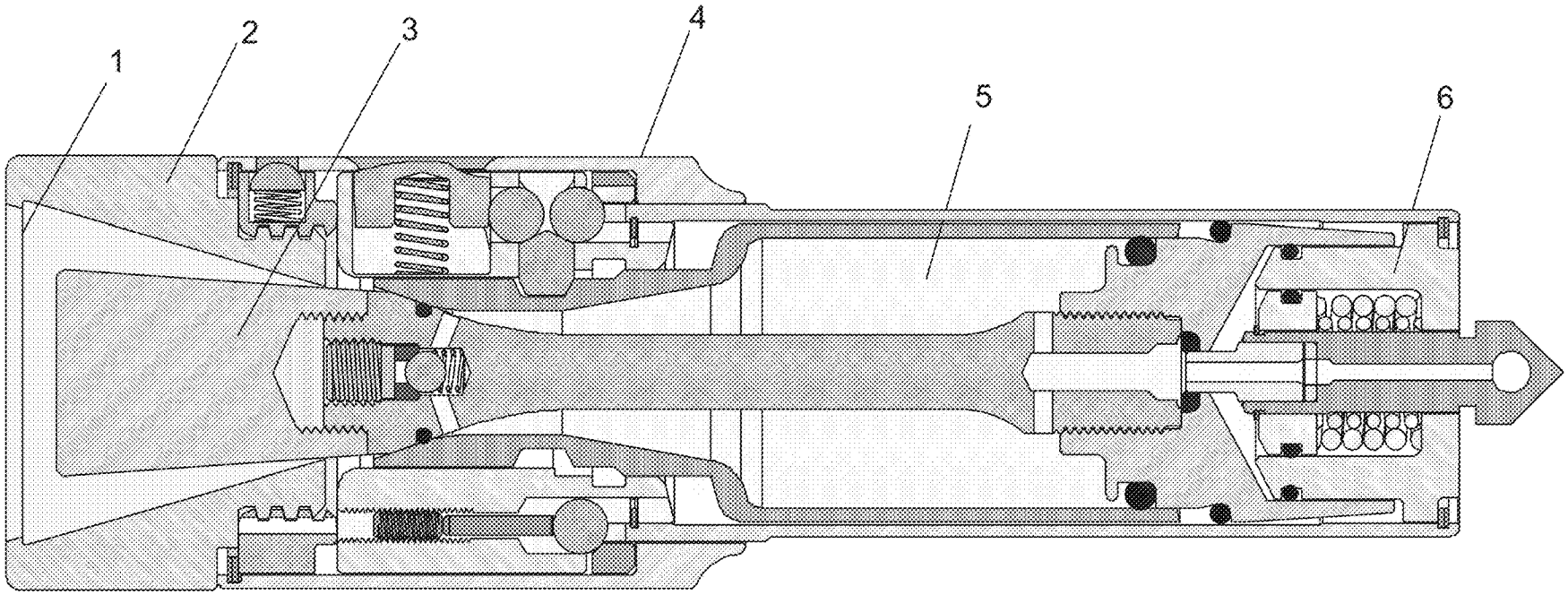
FIG. 1 shows an air blast launcher according to one embodiment of the present invention, as a line drawing and sectional view taken down the centerline.
Figure 1A:
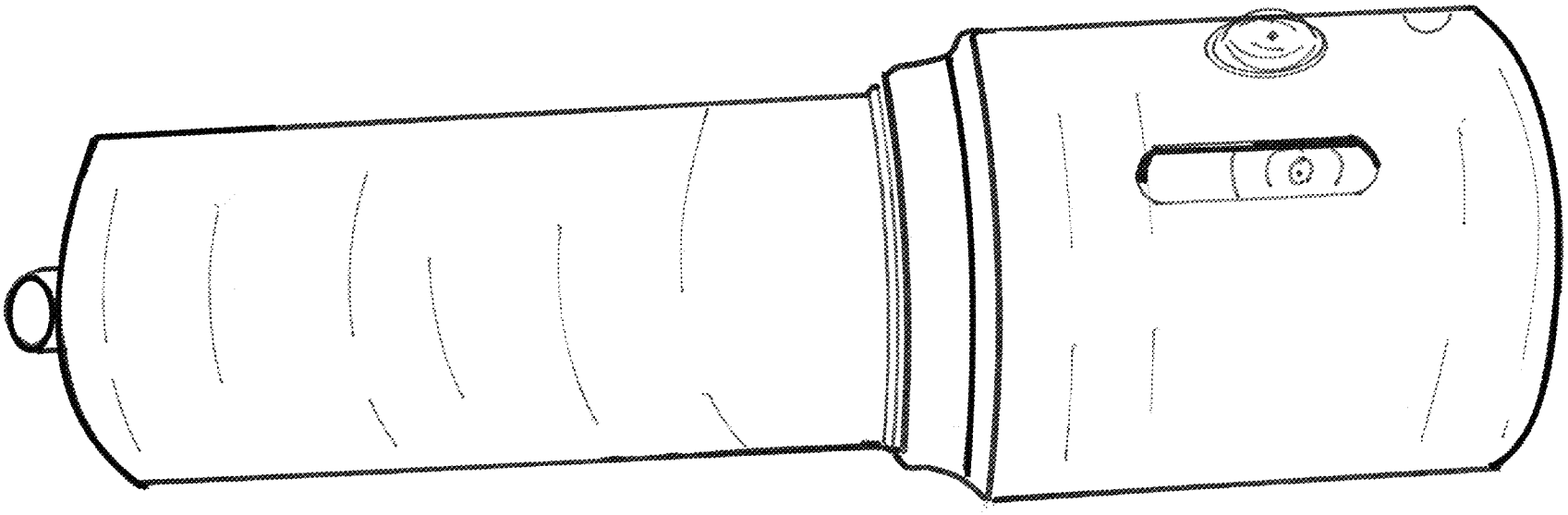
FIG. 1*a* shows an air blast launcher side photographic representation of the apparatus of FIG. 1.

The following is a list of element numbers and at least one word used to describe that element. It is understood that none of the embodiments disclosed herein are limited to these words, and these element numbers can further pertain to other words that would be understood by a person of ordinary skill reading and reviewing this disclosure in its entirety.

| | |
|---|---|
| 1 | sharp edge |
| 2 | outer flow nozzle member |
| 3 | inner flow nozzle member |
| 4 | barrel assembly; pressure vessel |
| 5 | nozzle assembly |
| 6 | nipple assembly |
| 7 | valve rod; plug |
| 8 | pressure vessel |
| 8-74 | shoulder |
| 9 | valve stop; plug |
| 10 | valve seal |
| 11 | pressure vessel seal |
| 12 | nipple seal |
| 13 | stop buffer |
| 14 | valve screw |
| 15 | seal seat |
| 16 | valve ball |
| 17 | charging spring |
| 18 | charging passage |
| 19 | fill passage |
| 20 | charging recess |
| 21 | initiation passage |
| 22 | initiation recess |
| 23 | charging volume |
| 24 | nozzle |
| 25 | screw mount |
| 26 | safety sleeve |
| 27 | body sleeve; handle |
| 28 | barrel |
| 29 | initiation button; trigger |
| 30 | button spring |
| 31 | initiation ball |
| 32 | initiation pin; travel stop |
| 32a | recess |
| 33 | safety ball |
| 34 | safety insert |
| 35 | body retainer ring |
| 36 | safety stop screw |
| 37 | safety stop pin |
| 38 | safety stop ball |
| 39 | detent ball |
| 40 | detent spring |
| 41 | attachment mount |
| 42 | detent recess |
| 43 | attachment mount retainer ring |
| 44 | nipple assembly retainer ring |
| 45 | nipple retainer groove |
| 46 | attachment mount groove |
| 47 | ball recess |
| 48 | initiation pin passage |
| 49 | initiation ball passage |
| 50 | adjustment passage |
| 51 | screw attachment thread |
| 52 | threaded passage |
| 53 | safety stop passage |
| 54 | body retainer groove |
| 55 | initiation nipple; plug |
| 56 | spring retainer |
| 57 | body plug |
| 58 | nipple mount |
| 59 | rupture disk |
| 60 | disk shear support |
| 61 | pressure indicating spring assembly |
| 62 | body plug seal |
| 63 | spring retainer ring |
| 64 | spring retainer seal |
| 65 | nipple passage |
| 66 | shear support passage |
| 67 | rupture passage |
| 68 | lanyard passage |
| 69 | pressure indicating groove |
| 70 | body plug seal groove |
| 71 | spring retainer groove |
| 72 | nipple mount groove |
| 73 | initiation volume |
| 74 | stop shoulder |

-continued

| | |
|---|---|
| 75 | nozzle passage |
| 76 | expansion passage |
| 77 | straight gas flow |
| 78 | ring vortex |
| 79 | O-ring ultra low mass projectile |
| 80 | water bottle |
| 81 | water space |
| 82 | attachment thread |
| 83 | membrane seal; frangible |
| 84 | bottle support sleeve |
| 85 | bottle neck passage |
| 86 | support space |
| 87 | bottle mount passage |
| 88 | water mist attachment accessary |
| 89 | aerated water |
| 90 | turbulent flow |
| 91 | bottle bottom |
| 92 | stop screw |
| 93 | nose cover; frangible cap |
| 94 | inner sabot |
| 95 | guide rod |
| 96 | ring airfoil glider projectile; munition |
| 97 | mounting case; housing |
| 98 | outer sabot |
| 99 | rod mounting means |
| 100 | inlet flow director |
| 101 | attachment mounting thread |
| 102 | inlet flow passage |
| 103 | seal lip |
| 104 | pressure release passage |
| 105 | projectile mount snap groove |
| 106 | projectile snap groove |
| 107 | outer sabot stop rib |
| 108 | outer sabot stop shoulder |
| 109 | rifling |
| 110 | inner sabot stop rib |
| 111 | case sealing edge |
| 112 | nose cover groove |
| 113 | folding ridge |
| 114 | rod stop shoulder |
| 115 | stop screw thread |
| 116 | nose cover mounting passage |
| 117 | rod flow director |
| 118 | expansion space |
| 119 | folded petal |
| 120 | inner sabot rod passage |

DESCRIPTION OF THE PREFERRED EMBODIMENT

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates. At least one embodiment of the present invention will be described and shown, and this application may show and/or describe other embodiments of the present invention. It is understood that any reference to "the invention" is a reference to an embodiment of a family of inventions, with no single embodiment including an apparatus, process, or composition that should be included in all embodiments, unless otherwise stated. Further, although there may be discussion with regards to "advantages" provided by some embodiments of the present invention, it is understood that yet other embodiments may not include those same advantages, or may include yet different advantages. Any advantages described herein are not to be construed as limiting to any of the claims. The usage of words indicating preference, such as "preferably," refers to features and aspects that are present in at least one embodiment, but which are optional for some embodiments.

The use of an N-series prefix for an element number (NXX.XX) refers to an element that is the same as the non-prefixed element (XX.XX), except as shown and described. As an example, an element 1020.1 would be the same as element 20.1, except for those different features of element 1020.1 shown and described. Further, common elements and common features of related elements may be drawn in the same manner in different figures, and/or use the same symbology in different figures. As such, it is not necessary to describe the features of 1020.1 and 20.1 that are the same, since these common features are apparent to a person of ordinary skill in the related field of technology. Further, it is understood that the features 1020.1 and 20.1 may be backward compatible, such that a feature (NXX.XX) may include features compatible with other various embodiments (MXX.XX), as would be understood by those of ordinary skill in the art. This description convention also applies to the use of prime (′), double prime (″), and triple prime (‴) suffixed element numbers. Therefore, it is not necessary to describe the features of 20.1, 20.1′, 20.1″, and 20.1‴ that are the same, since these common features are apparent to persons of ordinary skill in the related field of technology.

Although various specific quantities (spatial dimensions, temperatures, pressures, times, force, resistance, current, voltage, concentrations, wavelengths, frequencies, heat transfer coefficients, dimensionless parameters, etc.) may be stated herein, such specific quantities are presented as examples only, and further, unless otherwise explicitly noted, are approximate values, and should be considered as if the word "about" prefaced each quantity. Further, with discussion pertaining to a specific composition of matter, that description is by example only, and does not limit the applicability of other species of that composition, nor does it limit the applicability of other compositions unrelated to the cited composition.

What will be shown and described herein, along with various embodiments of the present invention, is discussion of one or more tests that were performed. It is understood that such examples are by way of example only, and are not to be construed as being limitations on any embodiment of the present invention. Further, it is understood that embodiments of the present invention are not necessarily limited to or described by the mathematical analysis presented herein.

Various references may be made to one or more processes, algorithms, operational methods, or logic, accompanied by a diagram showing such organized in a particular sequence. It is understood that the order of such a sequence is by example only, and is not intended to be limiting on any embodiment of the invention.

This document may use different words to describe the same element number, or to refer to an element number in a specific family of features (NXX.XX). It is understood that such multiple usage is not intended to provide a redefinition of any language herein. It is understood that such words demonstrate that the particular feature can be considered in various linguistical ways, such ways not necessarily being additive or exclusive.

What will be shown and described herein are one or more functional relationships among variables. Specific nomenclature for the variables may be provided, although some relationships may include variables that will be recognized by persons of ordinary skill in the art for their meaning. For example, "t" could be representative of temperature or time, as would be readily apparent by their usage. However, it is further recognized that such functional relationships can be expressed in a variety of equivalents using standard techniques of mathematical analysis (for instance, the relationship F=ma is equivalent to the relationship F/a=m). Further, in those embodiments in which functional relationships are implemented in an algorithm or computer software, it is understood that an algorithm-implemented variable can correspond to a variable shown herein, with this correspondence including a scaling factor, control system gain, noise filter, or the like.

Various embodiments of the present invention pertain to a hand carryable device that uses a stored charge of compressed gas, the compressed gas when released operating an end effector. The end effector can be any device that is adapted and configured to use compressed gas to create a non-lethal effect. Various embodiments shown herein, as examples, will illustrate end effectors that create and direct a toroidal gas vortex, create a propelled mist of liquid, or launch solid projectiles.

Preferably, the compressed gas is stored in a pressure vessel within the device. In some embodiments, the gas is air pressurized to more than 200 psig (as measured at standard temperature and pressure conditions); in still further embodiments the gas pressure is more than 500 psig; and in yet other embodiments the gas pressure is more than 1000 psig. However, in yet other embodiments the compressed gas is created by the explosion of a mixture of a fuel and oxidizer. Although these explosive embodiments could have combustion chambers different than the pressurized assemblies shown herein, these embodiments can nonetheless use any of the end effectors shown and described herein.

Some embodiments utilize a pressurized assembly that is repeatedly rechargeable and reusable to power the non-lethal weapon. In some embodiments, there is a pressurized assembly that includes a central pressure vessel having proximal and distal openings, and a repeatedly separable, moveable plug in each aperture. As used herein, the term "proximal" refers to a direction closer to the user, and the word "distal" referring to a direction away from the user. For example, the non-lethal munitions discussed herein are launched from the distal end of the weapon. Further, the term "aft" refers to a direction the same as the proximal direction, and the term "fore" or "forward" generally refers to the direction that is the same as the distal direction. It is understood, however, to those of ordinary skill in the art that there may be some descriptions herein in which a different definition of these terms is correct.

In some embodiments, the pressurized assembly includes a proximal plug, a portion of which is received within (and sealed to) the proximal end of the central pressure vessel. This proximal plug is preferably interconnected to a distal plug that is received within the distal aperture of the pressure vessel. When the weapon is in a safe or storage condition, both the proximal and distal plugs are sealing their respective apertures. In those embodiments where the proximal and distal plugs are connected within the pressure vessel, the internal connection is preferably placed in a state of tension because of the difference in pressure between the interior chamber of the pressure vessel, and ambient conditions. However, in such embodiments, the pressure vessel itself does not have to react to the loads created by the pressure difference across the plugs.

In such embodiments, the distal and proximal plugs are preferably interconnected, such that the relative sliding motion of the proximal plug relative to the pressure vessel results in relative motion of the distal plug relative to the pressure vessel. This relative motion at the distal plug releases pressure from the distal end of the pressurized assembly, and the weapon is adapted and configured to provide the pressure to an end effector.

In this embodiment and as shown herein, the proximal plug and the distal plug of the pressurized assembly move in a forward direction relative to the pressure vessel. However, it is understood by those of ordinary skill in the art that other embodiments of the present invention are not so constrained, and instead include pressure vessels that move aft relative to a stationary set of interconnected proximal and distal plugs.

Preferably, the distal aperture of the pressure vessel and the distal aperture of the pressure vessel and the sealing end of the distal plug are adapted and configured such that after relative movement (i.e., relative movement of the forward plug and pressure vessel to release compressed gas), a diverging nozzle is created. This divergence can be established in terms of diverging angular relationships (as measured from the centerline of the pressure vessel), by a change in the cross sectional area of the gas flowpath in the direction of gas flow, or a combination of these. It is understood that in some embodiments there is a pressure difference between the gas within the internal chamber of the pressure vessel and ambient conditions that is more than about 2 to 1, such that the flow of gas between the distal aperture and the distal plug is choked. In those embodiments in which the distal plug and distal opening form a divergent nozzle, it is understood that this choking condition will create supersonic flow of the gas. As that supersonic gas flows into the end effector, the gas velocity decreases to below Mach 1, and this deceleration of the gas can create a shockwave. In those embodiments in which the end effector releases this shockwave, the noise of the shockwave provides a non-lethal deterrent effect at the target.

In yet another embodiment, the weapon includes a pressurized assembly that is slidably movable relative to the handle. Preferably, this pressurized assembly includes a pressure vessel with fore and aft apertures, an aft plug in the aft aperture, and a forward plug in the forward aperture. This assembly can slide along the longitudinal axis of the weapon, relative to the handle. In the safe or storage condition the assembly is maintained in place by a positionally-locking trigger mechanism. When the trigger mechanism is moved to fire the weapon, the positional lock is released, and the pressurized assembly can translate to a firing position. This translational movement of the pressurized assembly is limited in one direction by the positional lock of the trigger mechanism, and in the other direction by interfering contact with another component of the weapon (which could be an abutting shoulder or another trigger-actuated lock, as examples).

In this embodiment, when the pressure vessel is in the aftmost, safe position, there is a pressure differential acting within another chamber created between the aft plug and another component of the weapon. The pressure in this aft chamber provides a biasing force that pushes the pressurized assembly toward the forward direction. This pressure load is reacted by the locking feature of the trigger mechanism. When this lock is removed, the pressure in the aftmost chamber is able to push the pressurized vessel forward. Although what is shown and described herein is an aft plug that is biased forward by a relatively low pressure differential in an aft chamber, it is also recognized that this forward biasing force could also be created by a mechanical spring acting between the aft plug and another component of the weapon.

In still further embodiments, the weapon including the translating pressurized assembly discussed above further includes a third plug that is preferably at a fixed location relative to the pressurized assembly. The aft plug includes an aperture that is in fluid communication with the higher differential pressure of the chamber within the pressure vessel. In the safe position, the third plug seals the flow aperture of the aft plug. This seal prevents the application of the higher pressure to the chamber created between the aft plug and the interior of the weapon. As discussed above, in the safe mode this aftmost chamber is pressurized to a lower pressure than the higher pressure of the pressure vessel, and therefore creates a relatively small axial load that is reacted against the locking mechanism.

However, when the pressurized assembly translates forward, the third plug comes out of a sealing engagement with the aperture of the aft plug, thus permitting high pressure gas from the pressure vessel to flow into the aft chamber. Therefore, the pressure from the internal chamber of the pressure vessel is now applied on both sides of the aft plug. The pressure differential across the forward plug creates a forward-directed force on the attached pair of aft and rear plugs, such that these attached plugs are pulled forward (relative to the pressure vessel) with releases gas from the forward opening of the pressure vessel.

In one embodiment of the present invention there is an end effector that creates a blast of air directed at the target. In some embodiments, the end effector includes a divergent nozzle that creates a toroidal vortex of air that is able to maintain its identity and traverse a distance preferably of tens of feet to hit the target. When the vortex hits the target, the higher circulating velocity within the torus can create an uncomfortable scrubbing effect on the target. Still further, in some embodiments, the vortex has sufficient mass and velocity to strike the target and apply a lower frequency static pressure to the target.

In some embodiments, the formation of the vortex is enhanced by a sudden release of pressure. Various embodiments of the present invention include a pressure vessel having a movable plug, wherein the movable plug can be actuated to open an aperture in the pressure vessel in less than about one-tenth of a second. In still further embodiments, the formation of the vortex is enhanced by releasing pressure that is more than about twice ambient pressure. Various embodiments of the present invention achieve this and some embodiments include pressure vessels that are capable of holding up to 3000 psig, which achieves a pressure ratio across the pressure vessel aperture of about 200. In still further embodiments, it has been found that the vortex is enhanced by a sharp edge or other disturbance (similar to boundary layer tripping features) placed within a divergent nozzle. In some embodiments, there is a sharp edge near the exit (on either the inner nozzle member or outer nozzle member). In some embodiments, this sharp edge protrudes the otherwise smooth surface of the nozzle by about one one-hundredths of an inch to about one-tenth of an inch. A more preferable range in some embodiments is from four hundredths to six hundredths of height. Preferably, the edge is relatively sharp, and in some embodiments has a cross sectional shape that is rectangular or triangular. However, in still further embodiments it has been found that a rounded lip is also useful in enhancing the vortex.

Still further embodiments of the present invention include a divergent nozzle as an end effector. Preferably, the outer flowpath of the nozzle diverges (relative to the centerline of the pressure vessel) at a first angle, and the inner surface of the nozzle diverges at a second angle, the first angle being greater than the second angle. However, and in still further embodiments either of the outer surface of the nozzle flowpath or the inner surface of the nozzle flowpath can be generally parallel to the centerline of the pressure vessel, with the other nozzle flow surface having the diverging angle.

Still further embodiments of the present invention pertain to a pressurized assembly capable of being repeatedly rechargeable with gas such as air. Preferably, the pressurized assembly includes connected fore and aft plugs that are received within fore and aft opening, respectively, of a pressure vessel. The pressurized assembly is slidable on the weapon relative to a handle of the weapon. Still further in some embodiments, the connected fore and aft plugs are connected to each other, such that they move as a unit relative to the pressure vessel. After the pressurized assembly has discharged its gas, the assembly has translated forward on the weapon, and further the interconnected fore and aft plugs have translated forward relative to the pressure vessel. The user can reset the position of the plug relative to the pressure vessel by pushing the forward face of the forward plug in an aft direction, thus seating the interconnected plugs relative to the pressure vessel. After doing so, the position of the pressure vessel will be locked relative to the weapon by the locking mechanism of the trigger mechanism. This permits the trigger mechanism to be reset to the safe condition.

With the pressure vessel of the pressurized assembly now being at the safe location (but still unpressurized), the user actuates a check valve in the forward plug and introduces pressurized gas into the pressure vessel into the forward plug check valve and flow passages. In some embodiments the further introduction of gas pressure will also cause the interconnected fore and aft plugs to slide aft relative to the pressure vessel, thus place placing fore and aft plugs at the safe position. In yet other embodiments, the fore and aft plugs can be manually pushed aft to the safe location. When the aft plug is in the safe location, the third plug comes into contact with the aft face of the aft plug, thus providing pressure to the spring loaded pressure indicator 61.

Some of the same components have been created for the weapon as a means of only launching a blast of air or compressed gas along with a loud sound to stun and intimidate rather than injure. Various embodiments of the present invention do this by distraction created by the sound and impact of a safe ring vortex of air or gas. Additionally, the weapon has attachment accessories which may be added to use the air blast to propel a ring type non-lethal ultra low mass blunt trauma projectile of several types including rubber O-rings which produce a painful welt without bruising, along with the ring vortex and loud sound; a water mist projectile consisting of a large ball of water droplets to produce a whole body blunt trauma impact and loud sound of the air device, and; to launch a long range ring airfoil glider ultra low mass blunt trauma projectile with very low human vulnerability and injury effect which produces a similar welt on the skin and surface tissues as the O-rings, but at much longer ranges.

The materials of construction of the device in some embodiments can include materials having high strength, except for the resilient seals, flow directors buffers and 'projectiles'. Either metal or high strength composites may be used for appropriate parts. The attachments such as the ring airfoil launching mechanism can be made of high strength molded plastics as well as the ring airfoil projectiles.

The angles of flow directors and expansion spaces are well understood in engineering of pulse jets, pulse rockets and ramjets the angles herein are generally under 14 degrees divergence for the preferred embodiment. The capacity of the device as to quantity and pressure of air is to the device disclosed herein as a preferred embodiment are 2 cubic inches of 3000 psig gas or air. However, it is understood that the aforementioned parameters are applicable to some embodiments, but not limiting to other embodiments.

New generation blunt trauma weapons as described herein meet the demands for long range effectiveness and short range safety, which until now, have been mutually exclusive in past generations of blunt force projectile based non-lethal weapons. A solution in some embodiments is to have a lighter aerodynamic round that travels at a higher velocity. These new generation weapons combine Ultra Low Mass, high unit contact pressure and large effective impact area to achieve this much needed capability for military and police population control missions. Ultra Low Mass in some embodiments can be considered as having frontal cross sectional density of 0.8 g/cm$^2$ and less. In some embodiments this is used with a weapon with a 37-40 mm bore size will have a projectile mass of less than 9 g. The impact face of the projectile is large enough to spread the contact area at impact to minimize risk of injury while generating high levels of pain response. This performance also results in minimal risk of injury due to deep tissue bruising common of other blunt force trauma munitions.

Additionally, this low mass projectile should have sufficient aerodynamic characteristics to fly to the desired target on a straight trajectory with minimal loss in velocity. A typical service small arms projectile has sectional density of 21 g/cm$^2$ and a pointed shape resulting in several hundred meters of effective range. Some blunt trauma projectiles have a blunt round nose shape and a sectional density for flight of 2.4 g/cm$^2$ which limits effective range to around 40 meters . . . albeit the former is lethal and the latter is non-lethal.

The ultra-low mass non-lethal can be useful in encounters when employed in a secondary weapon like a grenade launcher attachment to the standard service weapon. However, the problem of distance and overcoming the lethal danger space of conventional small arms still effects its practicality over the entire spectrum of missions where a non-lethal would be very useful. That is where the concept of dual density is employed.

FIG. 1 shows a self-defense apparatus according to one embodiment of the present invention, shows a preferably sharp edge 1 used to cause turbulence in the outer diameter of the air blast created by the launcher to start the creation of a ring vortex from the gas flow being released between the outer flow nozzle 2 and the inner flow nozzle 3. The Launcher is made of three assemblies including a barrel assembly 4 containing a nozzle assembly 5 and a nipple assembly 6. The launcher is used to store and release a charge of compressed gas to create an air blast effect and loud sound for self-defense, and to power various accessory attachments.

FIGS. 1*a*-1*h* are photographic representations of the device shown in FIG. 1. This view shows the launcher that is approximately 6 inches long and between 1.5 to 2 inches in diameter so to be held in the hand for use. It is shaped as a small flashlight to provide easy of handling and pointing. And, it is heavy enough to be used as a small club for self-defense.

Figure 1B:
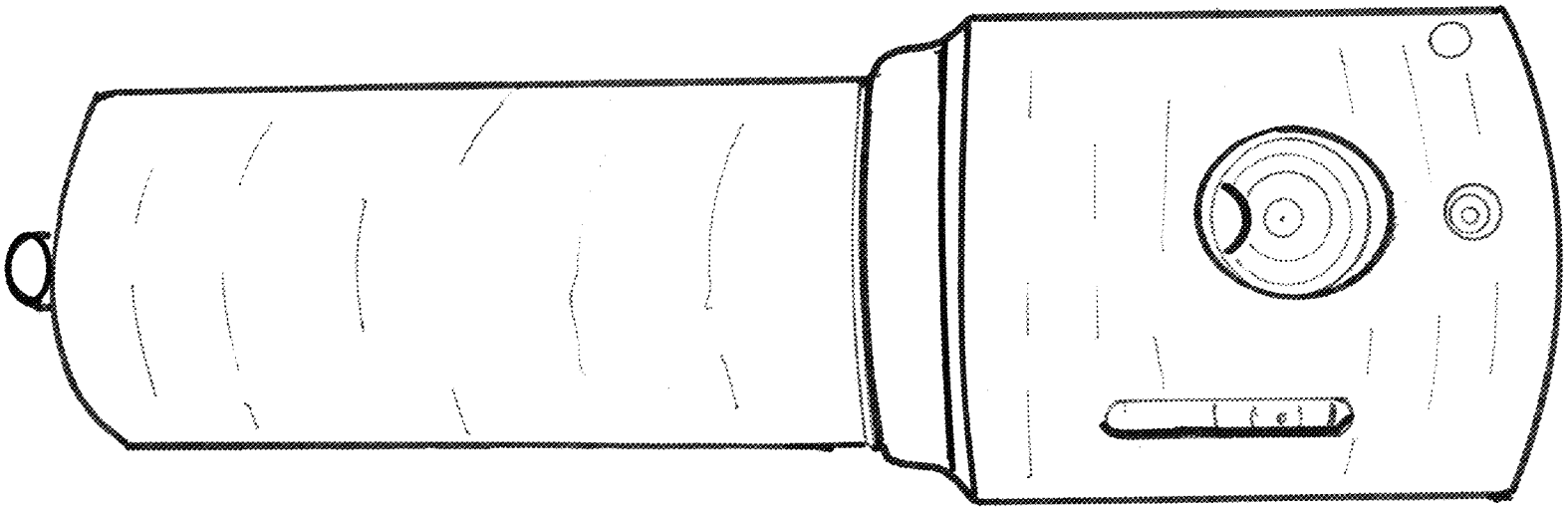
FIG. 1*b* shows an air blast launcher detail top photographic representation of the apparatus of FIG. 1.

FIG. 1*b* shows the launcher with directional arrows pointing in the direction of launch of the air blast and the safe and fire positions for operation of the launcher.

Figure 1C:
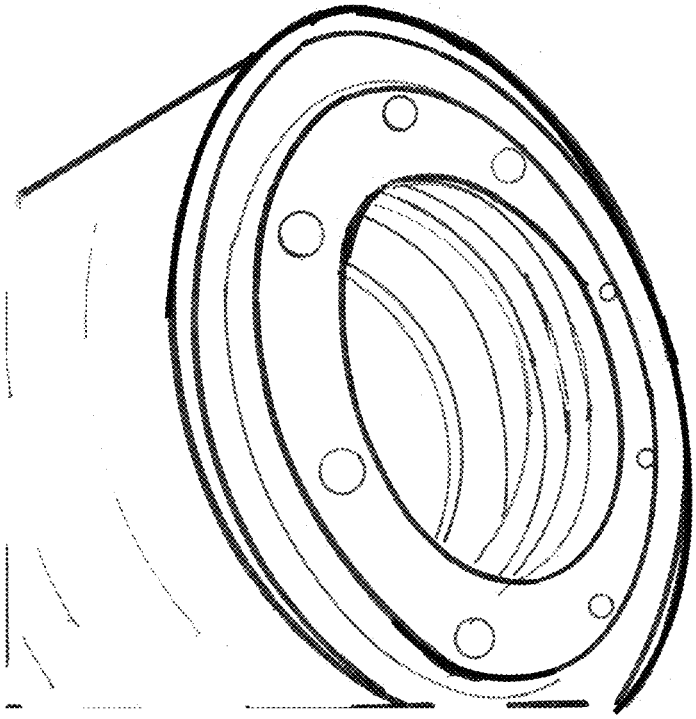
FIG. 1*c* shows an air blast launcher front photographic representation of the apparatus of FIG. 1.

FIG. 1*c* shows the front end of the bare launcher without any attachment assessor which can be mounted to this end. An internal threaded coupling can be seen on the interior of barrel assembly 4. The air blast is released from this end in an annular shape.

Figure 1D:
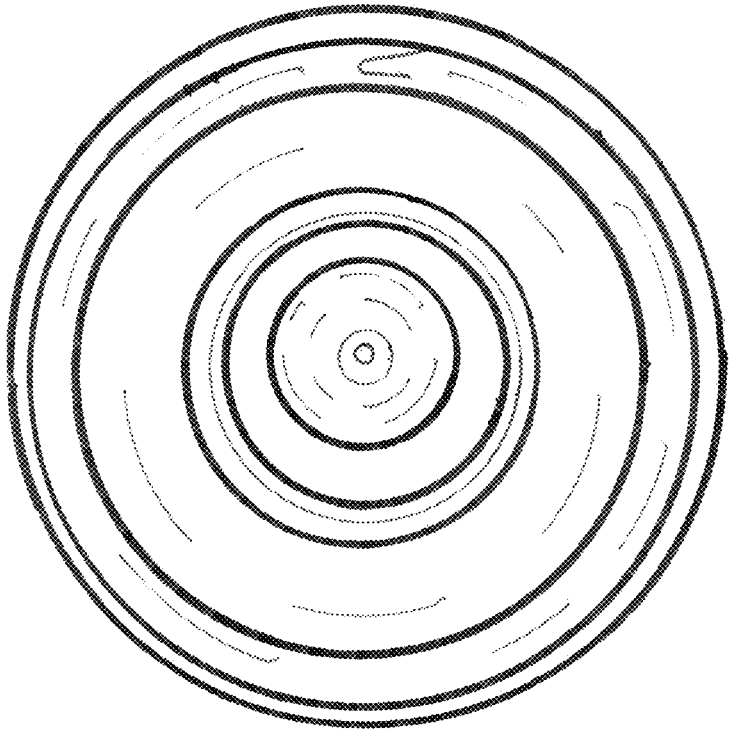
FIG. 1*d* shows an air blast launcher back photographic representation of the apparatus of FIG. 1.

FIG. 1*d* shows a photograph of the back end of the bare launcher that may be used to break car windows to gain egress or ingress to the vehicle and other uses.

Figure 1E:
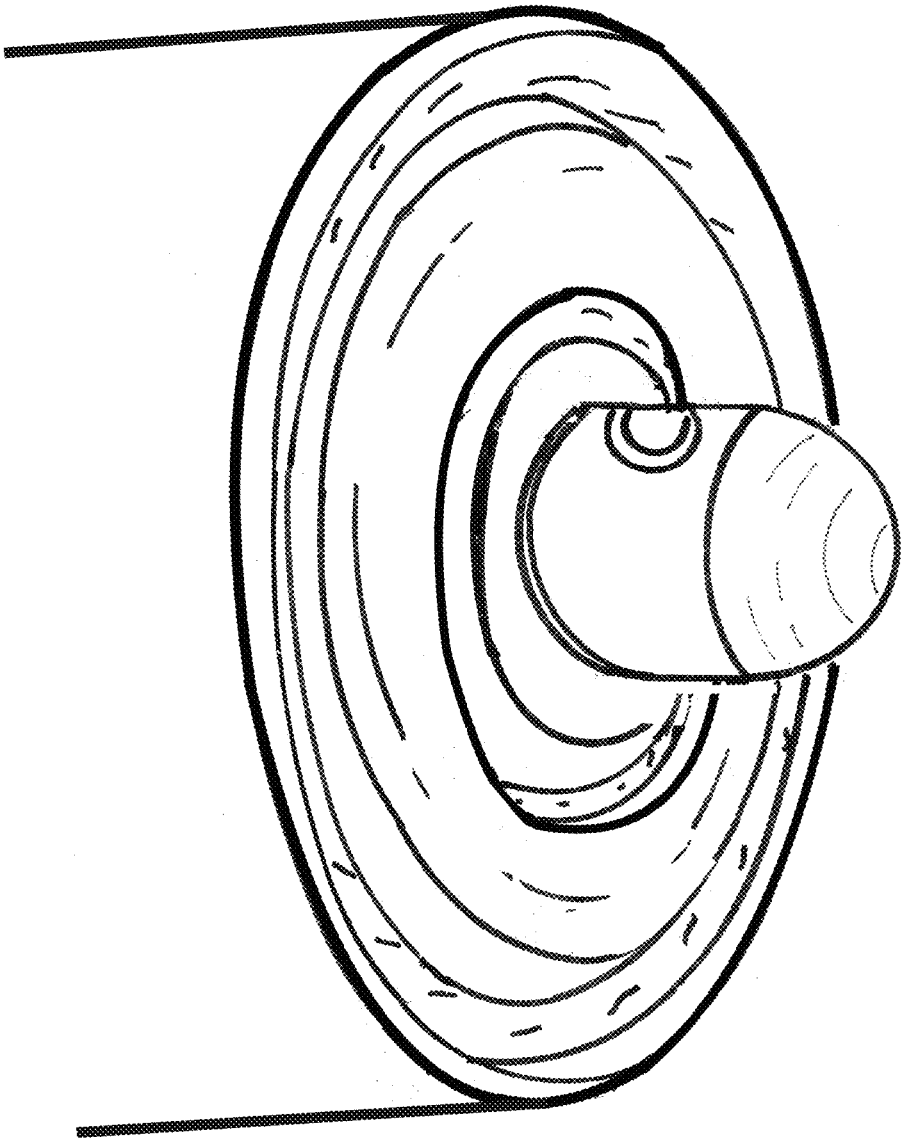
FIG. 1*e* shows an air blast launcher back, charge indicator minimum photographic representation of the apparatus of FIG. 1.

FIG. 1*e* shows a Back, Charge Indicator minimum photograph detailing the air pressure charge level, which can be determined by the user for maintenance and other purposes.

Figure 1F:
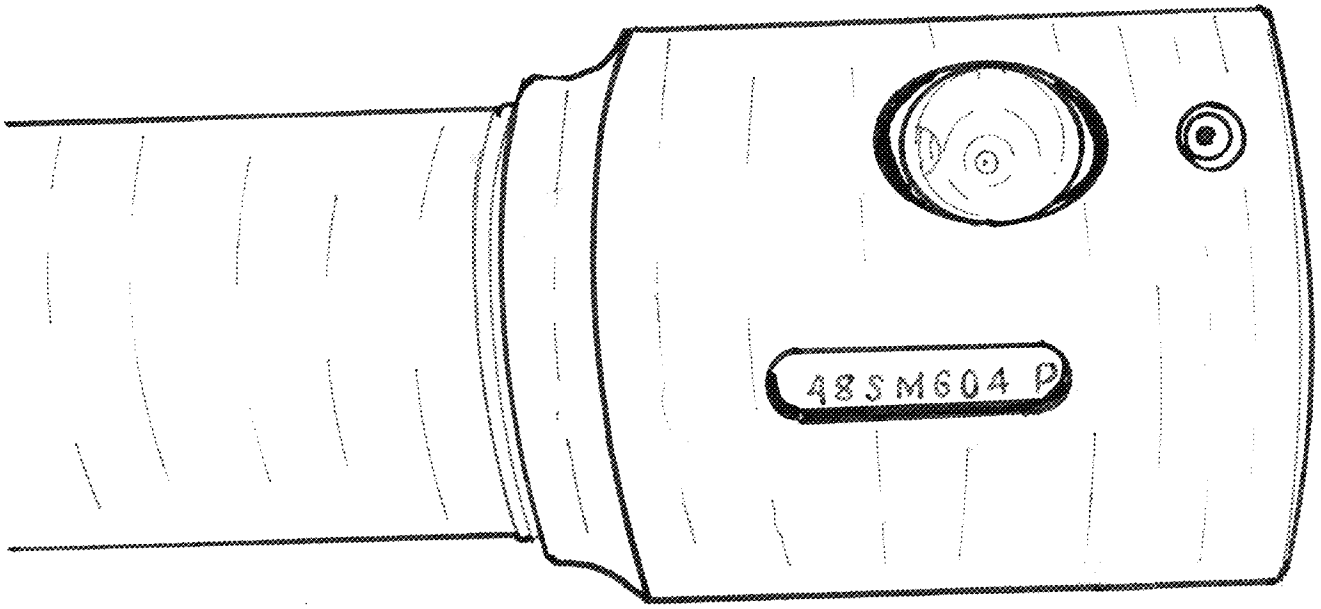
FIG. 1*f* shows an air blast launcher safety recess photographic representation of the apparatus of FIG. 1.

FIG. 1*f* shows a Safety Recess. The device has tactile interface for the user to determine without looking whether the device is locked in a safe operating position and cannot be fired or the air blast released.

Figure 1G:
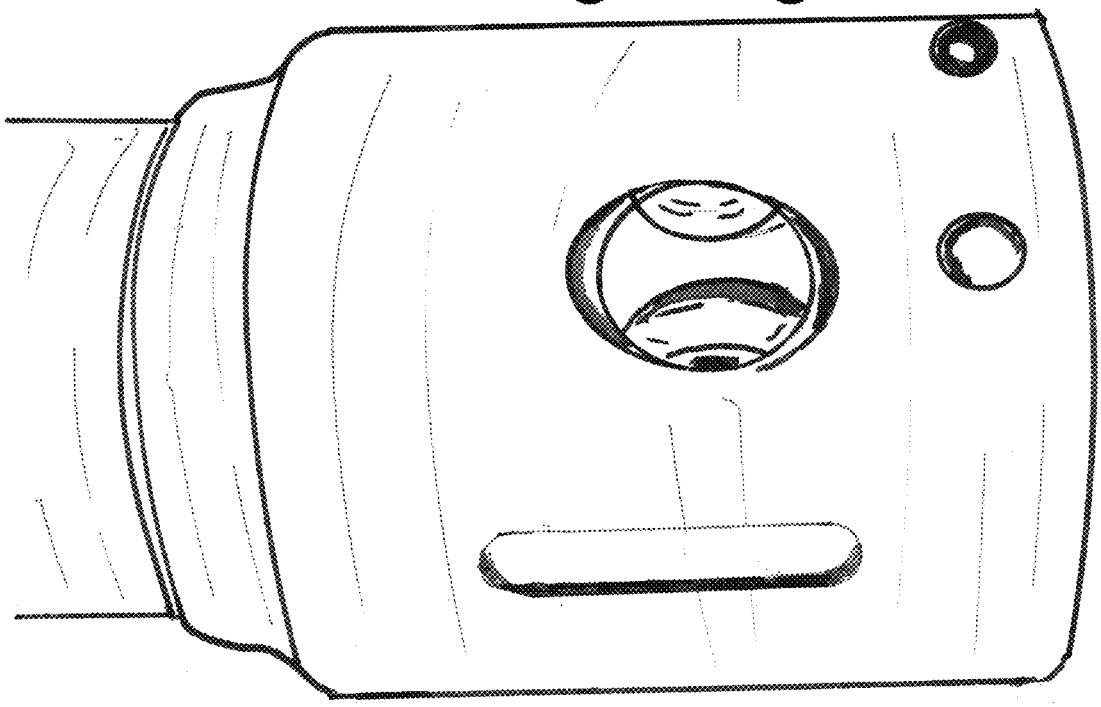
FIG. 1*g* shows an air blast launcher between safe and fire photographic representation of the apparatus of FIG. 1.

FIG. 1*g* shows the larger diameter of the device can be rotated to obtain a safe and locked or a ready to fire position by position of the larger end of the device (the device being shown at an intermediate position between Safe and Fire.

Figure 1H:
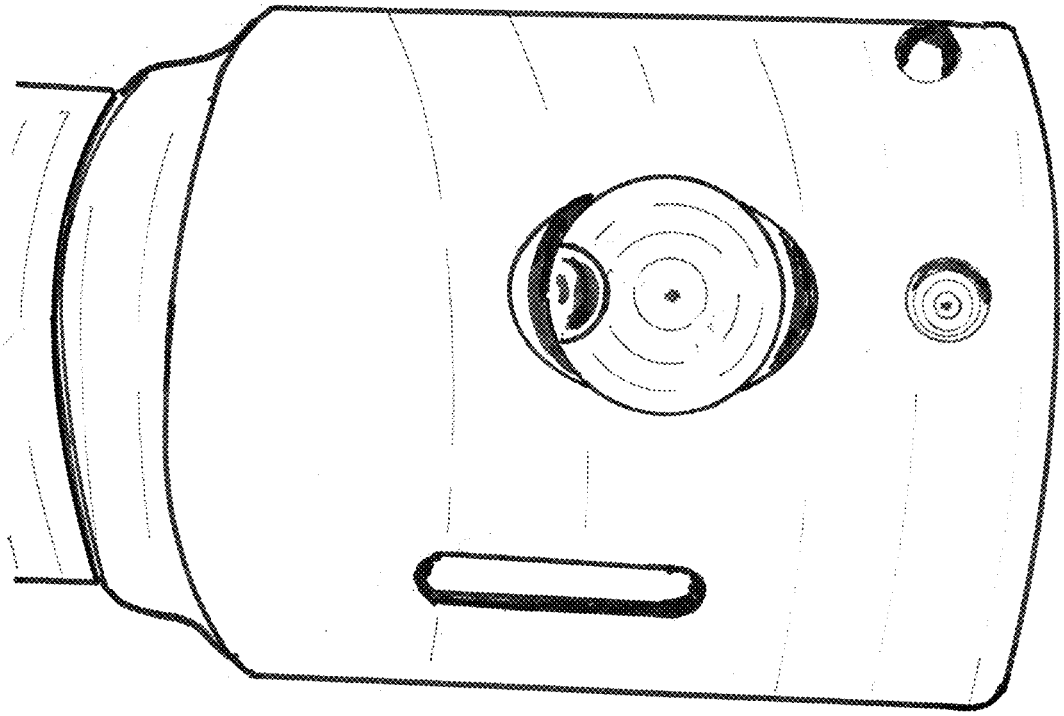
FIG. 1*h* shows an air blast launcher initiation button on fire position photographic representation of the apparatus of FIG. 1.

FIG. 1*h* shows the Initiation Button on Fire Position. The launcher is in the ready to use or fire state whereupon it can release the air blast when operated by the user.

Figure 2:
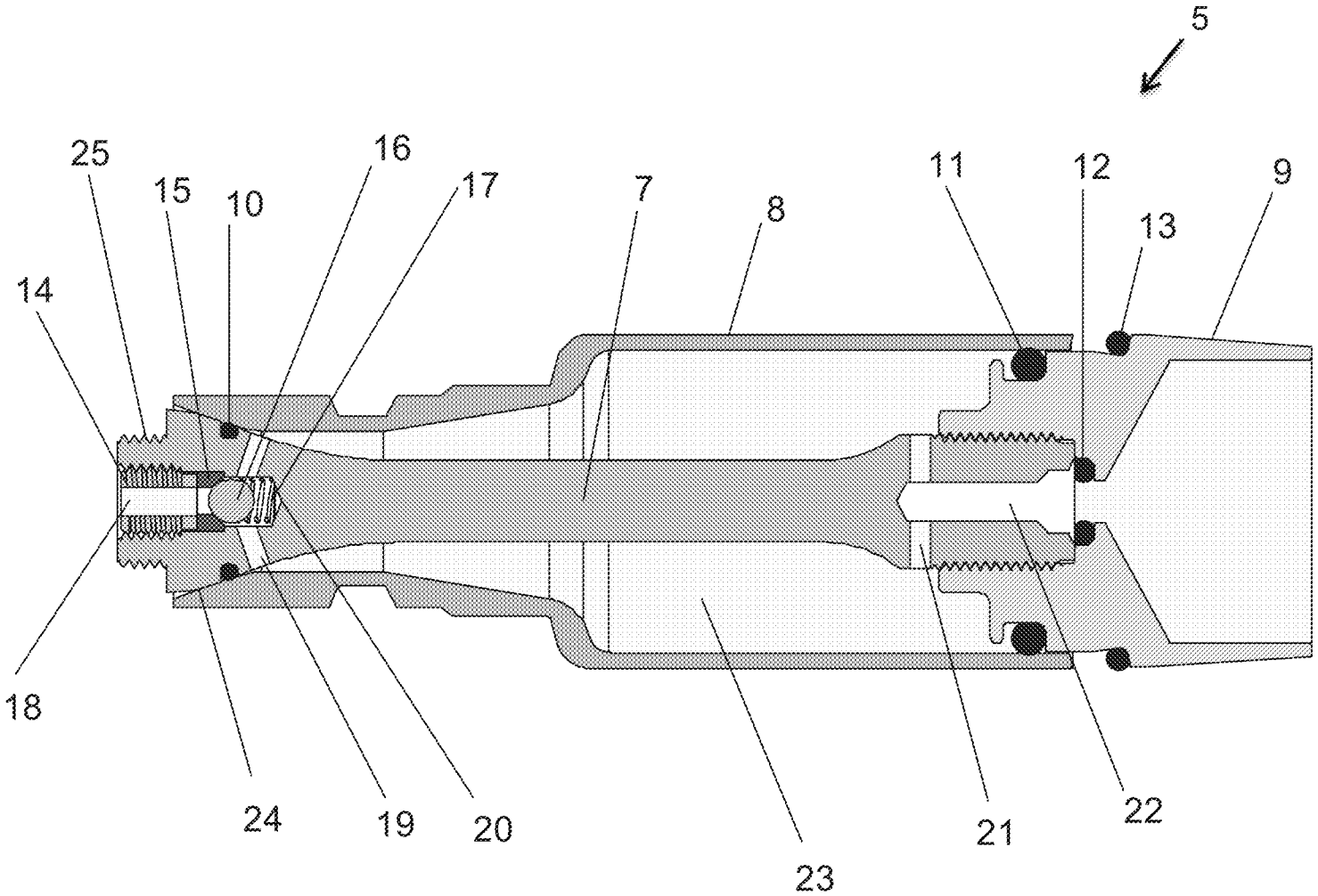
FIG. 2 shows an air blast launcher nozzle assembly from the apparatus of FIG. 1, and as shown as a line drawing and cross section taken down the longitudinal centerline.

FIG. 2 shows the Nozzle Assembly Detail 5. The nozzle assembly of the launcher includes pressure vessel 8 with a valve stop 9 installed to its larger back opening. Valve stop 9 has a valve rod 7 fixed to it by a screw thread or other attachment means. The pressure vessel 8 is sealed to the valve stop 9 with a pressure vessel seal 11 typically made up of an O-ring seal.

The valve rod 7 is sealed along a forward nozzle 24 opening in the pressure vessel 8, with another sealing means such as a valve seal 10 made up of typically an O-ring. This forms a charge volume 23 between the inner surface of vessel 8, front surfaces of valve stop 9, and outer surface of rod 7, for storage of compressed gas used to power the launcher. The valve rod 7 has a charging recess 20 in its forward end housing a gas charging means similar to a Schrader valve-type mechanism. This charging mechanism includes a charging passage 18 through a valve screw 14 used for retaining the charging mechanism, which includes a seal seat 15 (including typically a PTFE plastic or other seal material) to create a seal with a valve ball 16. Ball 16 is mounted in the recess behind the seal and held against the seal with a charging spring 17 to form an initial seal until the gas pressure in the charge volume stored in the device (in communication with the recess through at least one fill passage, typically a drilled hole the rod in the assembly) is high enough to self-seal the device. A screw mount 25 on the valve rod may be used to attach the device to a pressure charging means similar to how a tire valve works, or may be used to mount an attachment accessory to the rod.

The aft end of the valve rod has an initiation recess 22 in it communicating with the charge volume by at least one initiation passage 21, in the rod which is typically a drilled hole in the rod. Between the valve rod and the valve stop is a nipple seal 12 including typically of an O-ring for sealing the back of the nozzle assembly. A stop buffer 13 typically consisting of an O-ring or other resilient device cushions the valve stop and the pressure vessel when the launcher is fired. The structural components of the nozzle assembly are made from typically metal or other strong material to contain a high gas pressure typically in the order of 3000 psig stored in the launcher for long periods of time. However, in yet other embodiments the pressure stored is less, and the storage period may be for a short period of time.

Figure 2A:
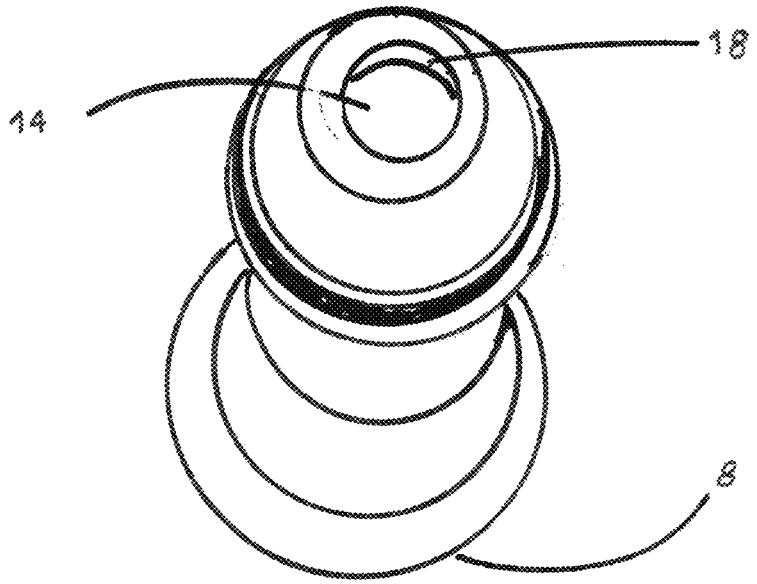
FIG. 2*a* shows an air blast launcher nozzle assembly front photographic representation of the apparatus shown in FIG. 2.
Figure 2B:
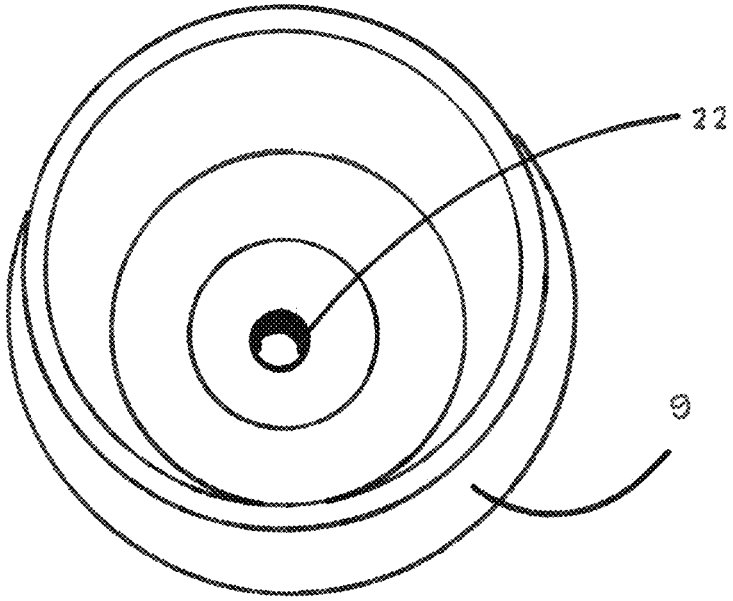
FIG. 2*b* shows an air blast launcher nozzle assembly back photographic representation of the apparatus shown in FIG. 2.
Figure 2C:
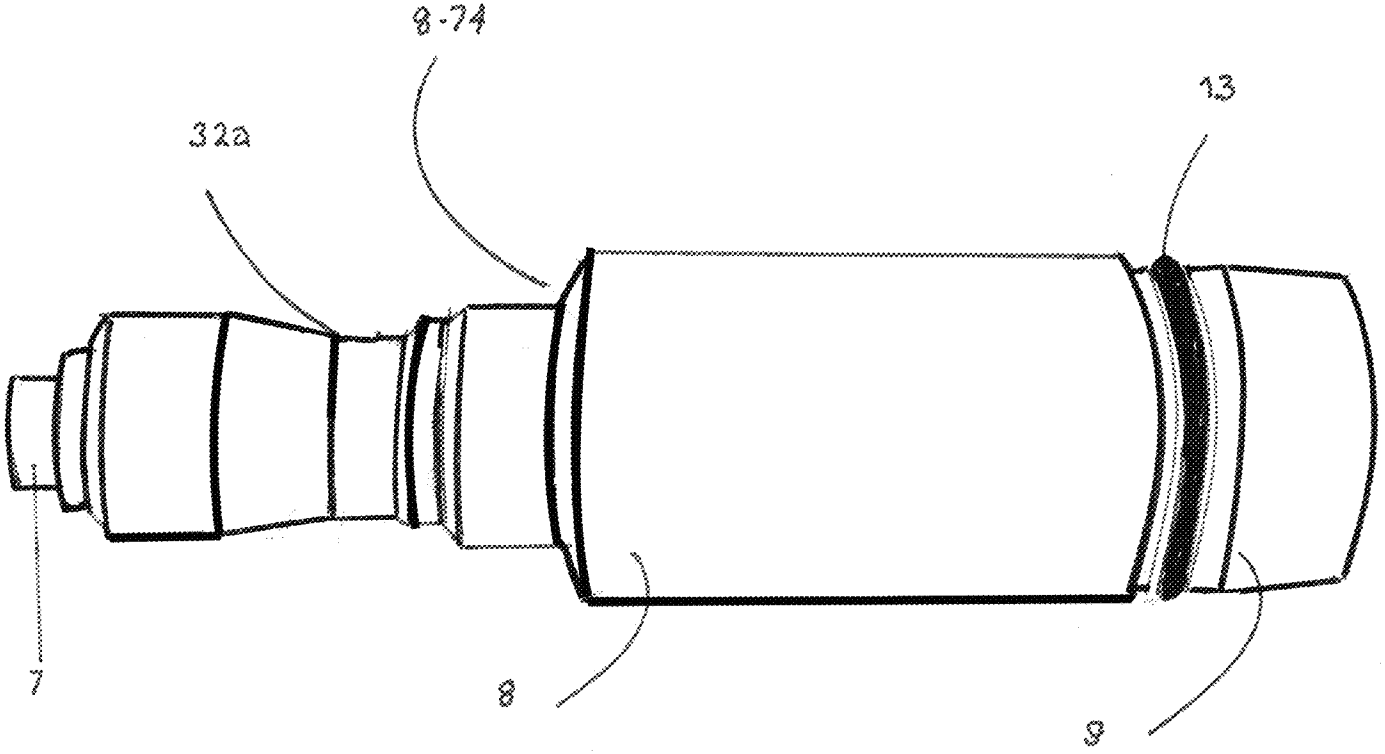
FIG. 2*c* shows an air blast launcher nozzle assembly side photographic representation of the apparatus shown in FIG. 2.
Figure 2D:
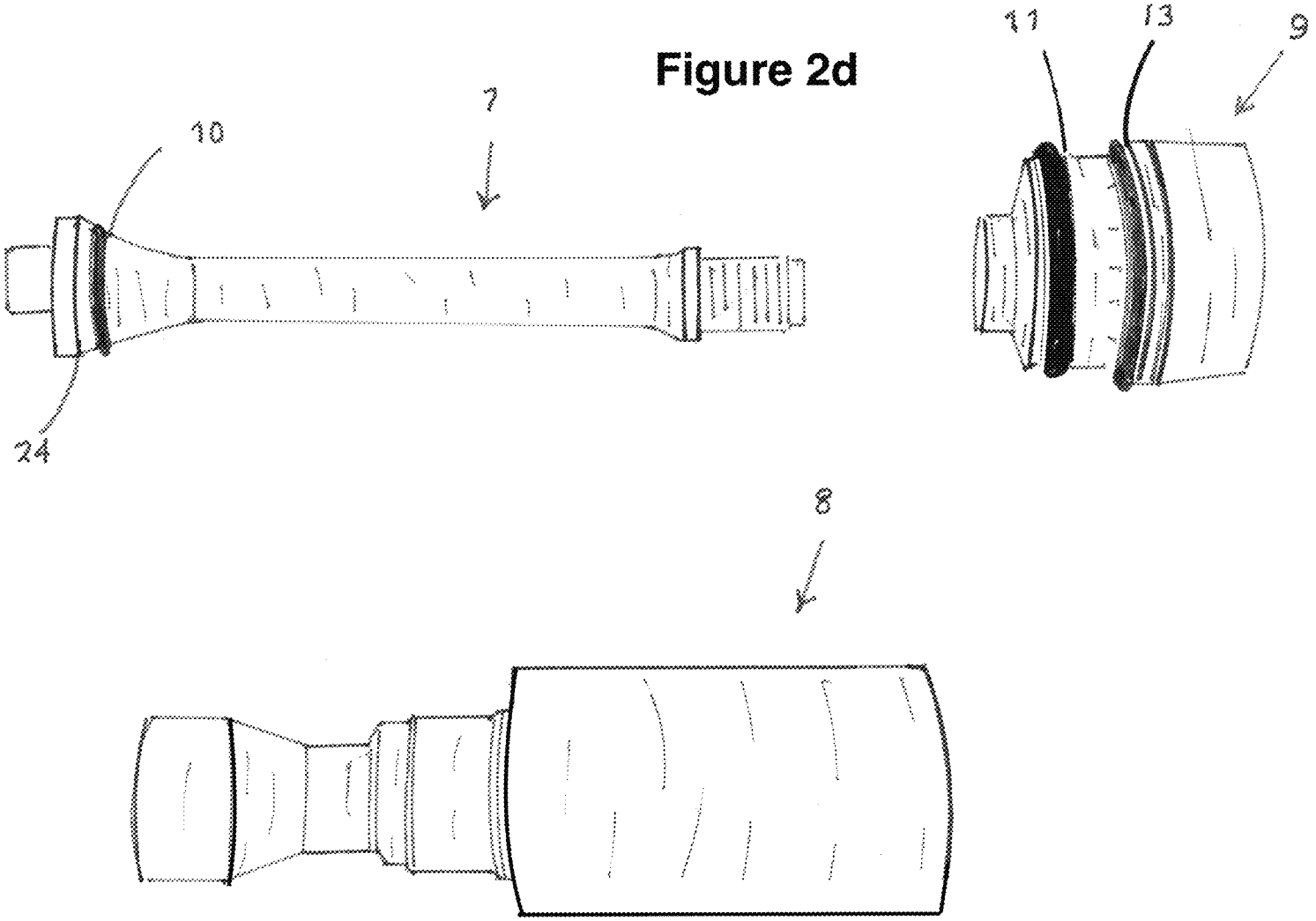
FIG. 2*d* shows an air blast launcher nozzle assembly parts photographic representation of the apparatus shown in FIG. 2.

FIG. 2*a* is a photograph view of the forward end of the assembled nozzle assembly 5, showing the charging passage 18 and valve screw threads 14. FIG. 2*b* is a photograph view of the aft end of the nozzle assembly 5, showing the aft-facing chamber of valve stop 9, as well as the aperture within valve stop 9 that is provided pressurized gas from initiation recess 22. FIG. 2*c* is a photograph view of the side of the nozzle assembly, the assembly including valve stop 9 inserted into the aft end of pressure vessel 8, with the forwardmost end of rod 7 extending from the forward end of pressure vessel 8. The exterior pressure vessel 8 further includes the recess 32*a* that receives initiation pin 32 during operation. Also shown is the forward facing shoulder 8-74 that abuts against stop shoulder 74 during operation. FIG. 2*d* is a photograph view of the component parts of the nozzle assembly 5, showing rod 7, pressure vessel 8, and valve stop 9.

Figure 2E:
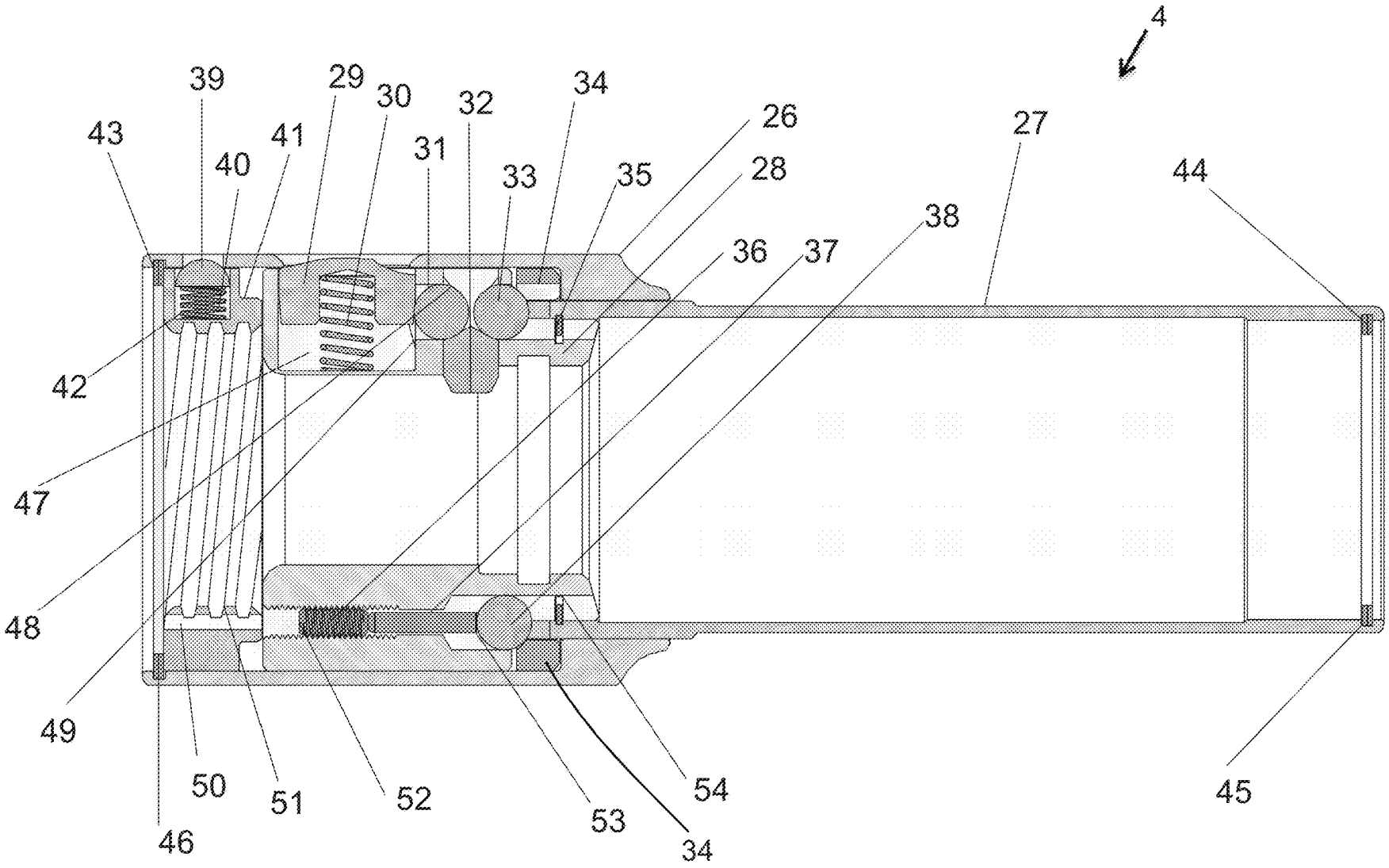
FIG. 2*e* shows an air blast launcher barrel assembly from the apparatus of FIG. 1, and as shown as a line drawing and cross section taken down the longitudinal centerline.

FIG. 2*e* shows the assembled barrel assembly 4 of the launcher. The barrel assembly 4 is made up of a barrel 28 attached to a body sleeve 27 by a press fit. A body retainer ring 35 mounted in a body retainer groove 54 in the barrel and the body sleeve provide structure for holding the operating components of the launcher.

The barrel 28 contains an initiation button 29 in a button recess hole 47 that has a button spring mounted and pushing outward from the recess 47. The button recess is adjacent an initiation ball passage 49 containing an initiation ball 31 in which is mounted in an initiation ball passage 49. The initiation ball 31 abuts against and prevents the movement of an initiation pin 32 against the button when the launcher is not being operated.

Further, the pin is retained in the aft direction from movement by a safety ball 33 mounted in the initiation ball passage, ball 33 being held in place by a safety insert 34 while the launcher is on safe. The safety insert includes at least one passage in it to release the ball when the launcher is fired. Also mounted in the barrel is a safety stop ball 38 held against the safety insert by a safety stop pin 53 and a safety stop screw 36. Both pin 53 and screw 36 are received within a passage in the barrel, and a clearance recess in the body sleeve. The passage is sized to fit the ball and pin to allow the screw mounted in a threaded section of the passage for adjustment against the safety insert. The safety insert is shaped to provide limited rotation travel by action of a recess formed in its forward surface. The safety insert in some embodiments is a ring mounted in safety sleeve 26 with pins to prevent its rotation. Safety insert 26 extends around the forward end of the assembled launcher, and includes external surfaces for gripping by the user. The safety sleeve 26 mounts surrounding the barrel and body sleeve to hold the safety insert in place at the aft end of the barrel and hold an attachment mount 41 for mounting removable accessories to the launcher with a screw mount thread 51 though the attachment mount. The attachment mount is retained by an attachment ring mount retainer ring 43 contained in an attachment mount groove 46 in the safety sleeve 26 at its forward open end.

The screw 52 is used to adjust the rotational tension of the safety sleeve with a turning tool used through an adjustment passage 50 in the attachment mount. A Detent ball 39 is mounted in a detent recess 42 in the attachment mount and held against the safety sleeve by a detent spring 40 to provide indication of safe and fire operational positions of the safety sleeve when it is in rotational alignment with the initiation button or a safety recess in the barrel. At the aft end of the body sleeve is a nipple assembly retainer ring 44 and nipple retainer groove to mount and hold the nipple assembly 6 in the body sleeve.

Figure 2F:
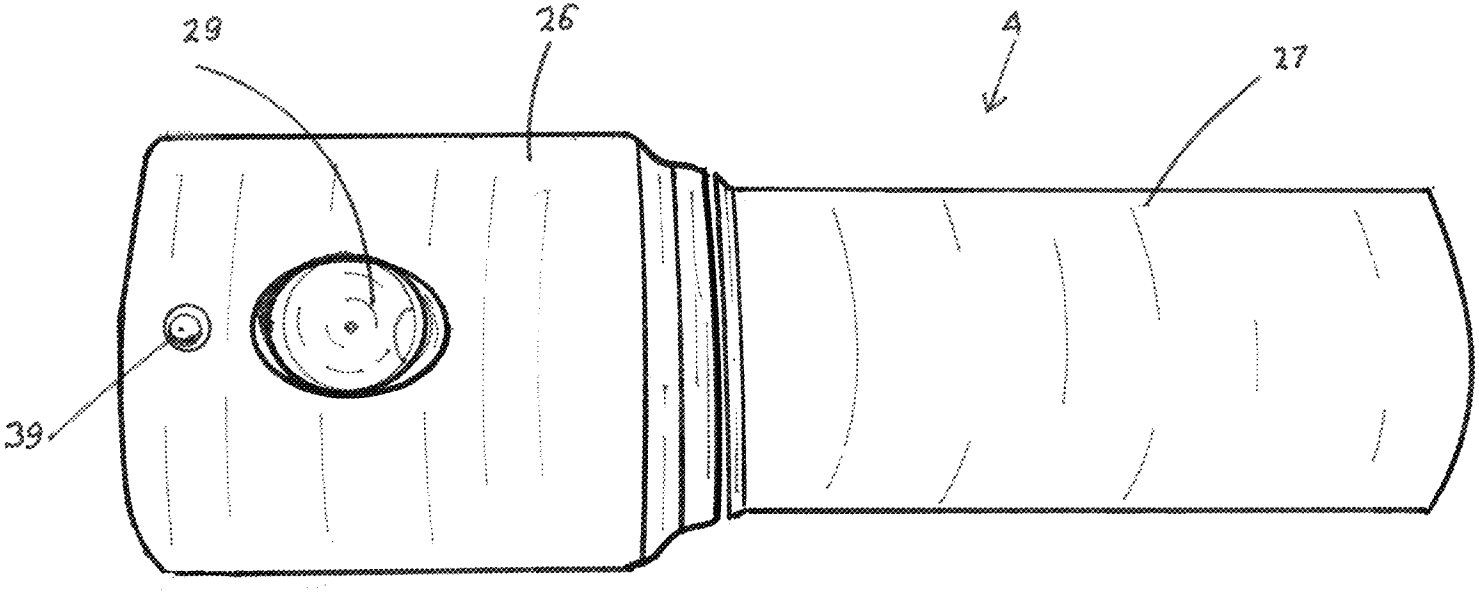
FIG. 2*f* shows an air blast launcher barrel assembly top photographic representation of the apparatus of FIG. 2*e*.
Figure 2G:
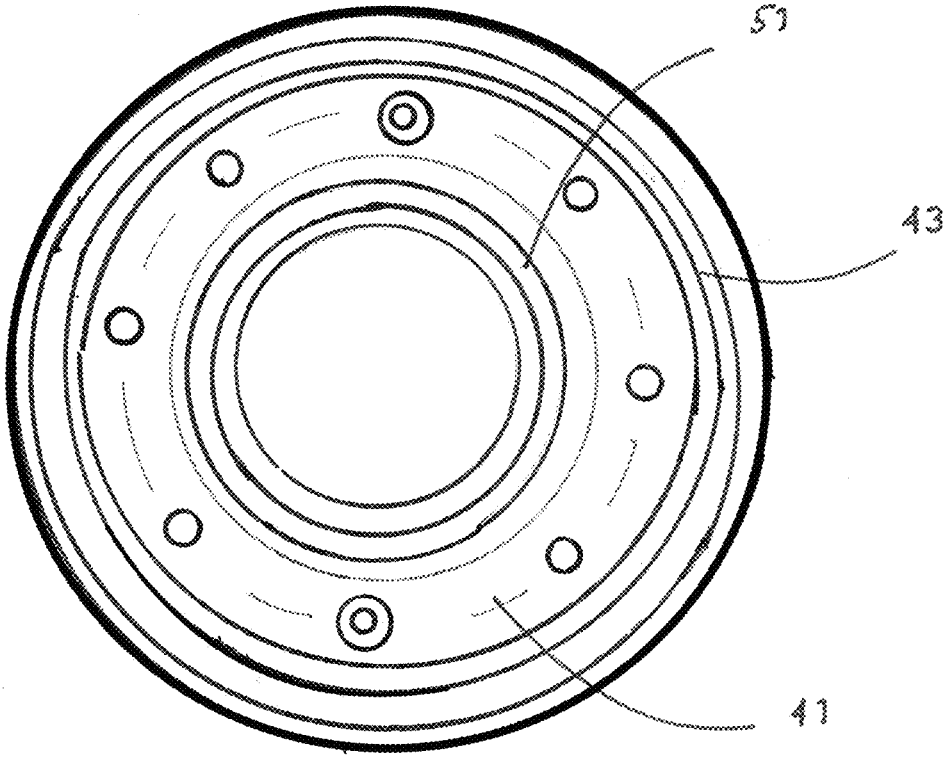
FIG. 2*g* shows an air blast launcher barrel assembly front photographic representation of the apparatus of FIG. 2*e*.
Figure 2H:
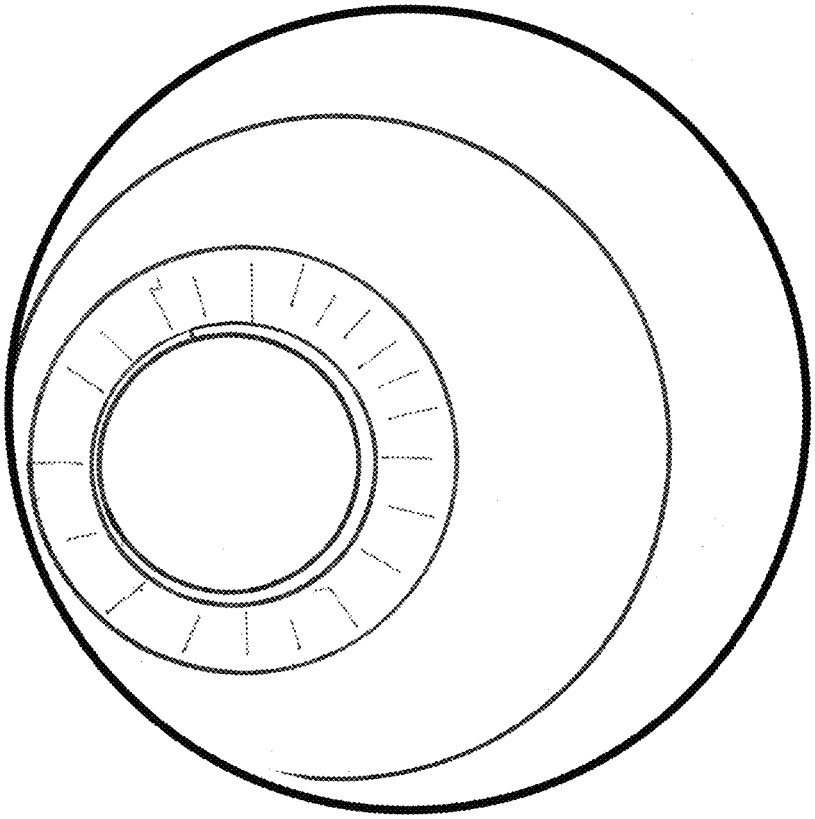
FIG. 2*h* shows an air blast launcher barrel assembly back photographic representation of the apparatus of FIG. 2*e*.

FIG. 2*f* is a photograph of the barrel assembly 4 in side view. Initiation button 29 and detent ball 39 can be seen through apertures in safety sleeve 26. FIG. 2*g* is a photograph of the attachment accessory mounting at the forward end of the barrel assembly 4, and generally looking directly down the central axis of the barrel assembly. FIG. 2*h* is a photograph of the aft open end of the body sleeve and barrel assembly.

Figure 2I:
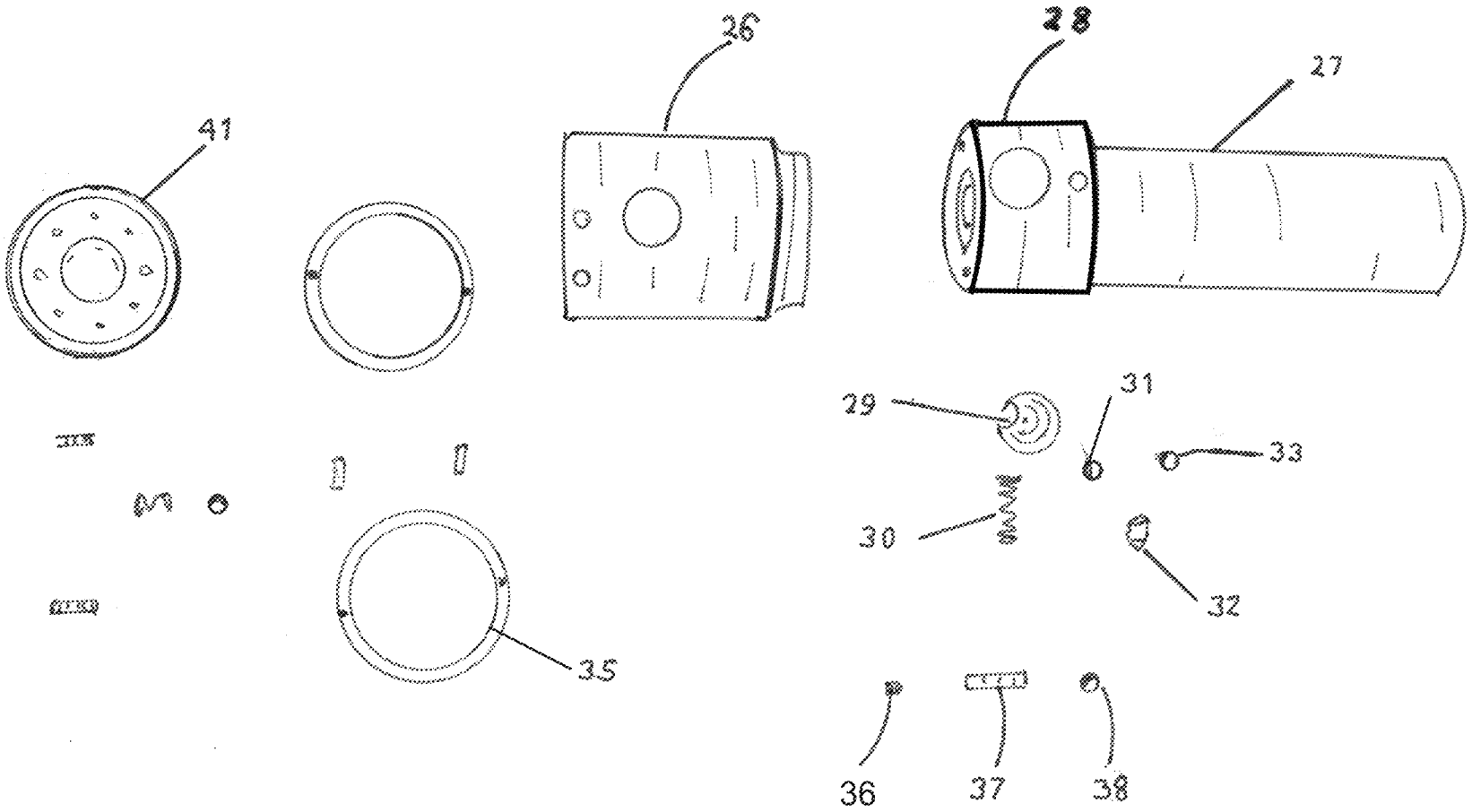
FIG. 2*i* shows an air blast launcher barrel assembly parts photographic representation of the apparatus of FIG. 2*e*.

FIG. 2*i* is a photograph of the separated components of the barrel assembly 4. The two pins for mounting into the two passages in the safety insert to fix it against rotation with the safety sleeve are shown. The two screws for mounting into the threaded passages in the attachment mount to fix it against rotation with the barrel are shown.

Figure 2J:
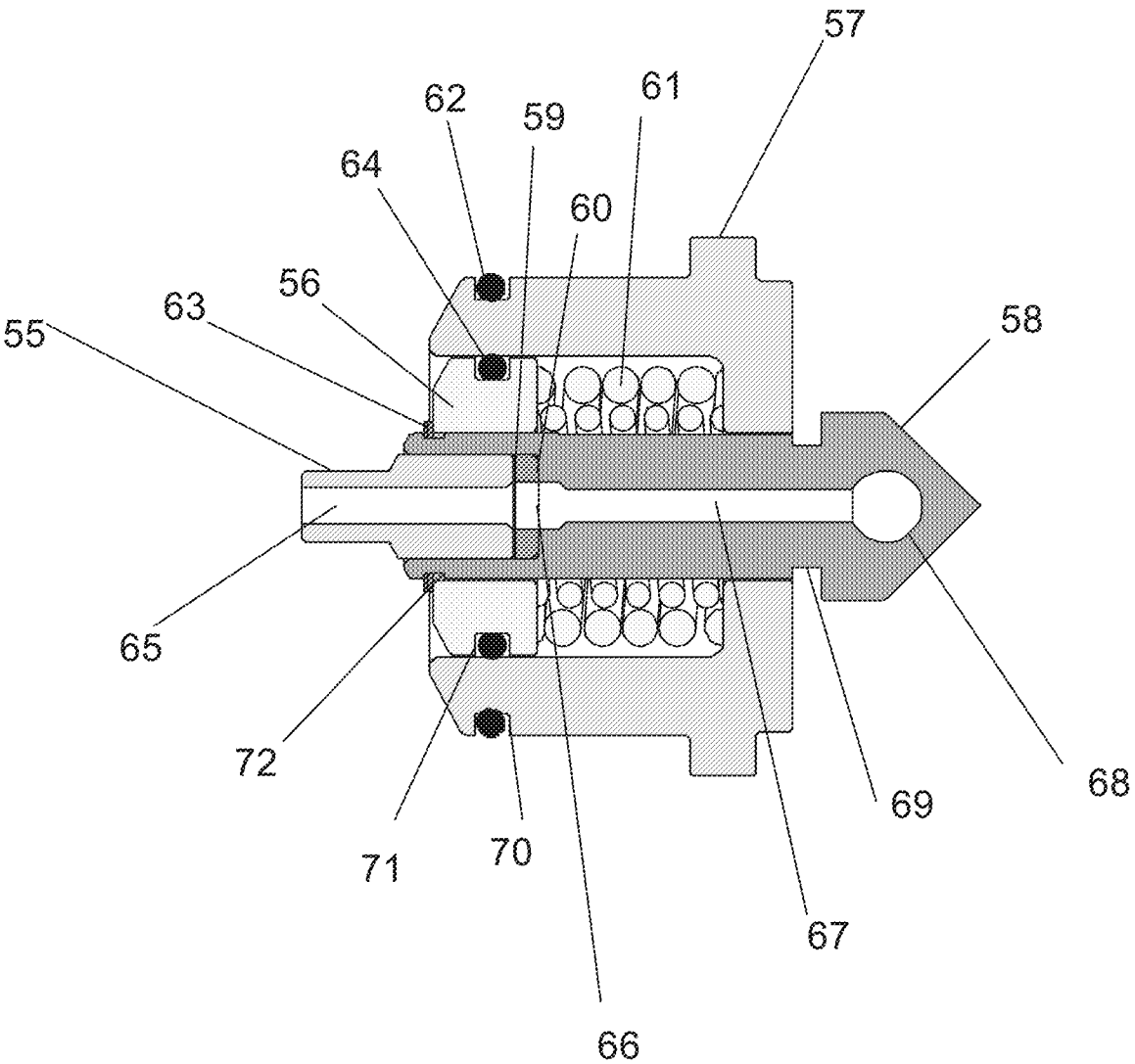
FIG. 2*j* shows an air blast launcher nipple assembly from the apparatus of FIG. 1, and as shown as a line drawing and cross section taken down the longitudinal centerline.

FIG. 2*j* shows a Nipple Assembly Detail 6. FIG. 2*j* shows the initiation nipple 55 mounted by an interference fit to a nipple mount 58 in a multi diameter passage through the mount 58. The nipple holds in place a rupture disk 59 which seals a nipple passage 65 communicating through the nipple against a shear support passage 66 through a disk shear support 60 so that upon excessive pressure the rupture disc will shear on release the pressure through the passage and out through a lanyard passage 68 to prevent damage to the launcher.

Figure 2K:
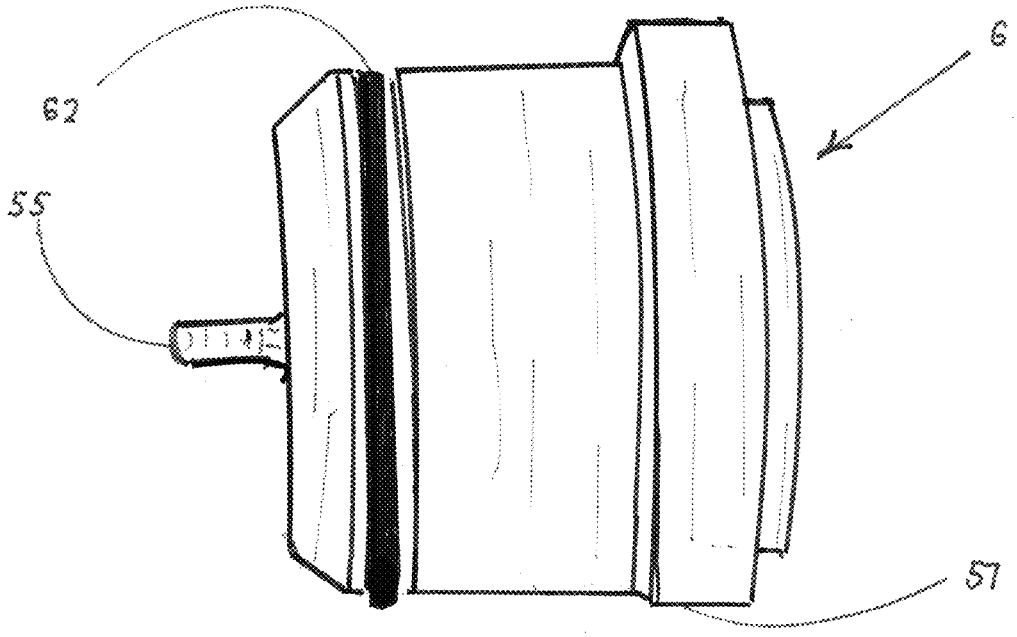
FIG. 2*k* shows an air blast launcher nipple assembly side photographic representation of the apparatus of FIG. 2*j*.
Figure 2L:
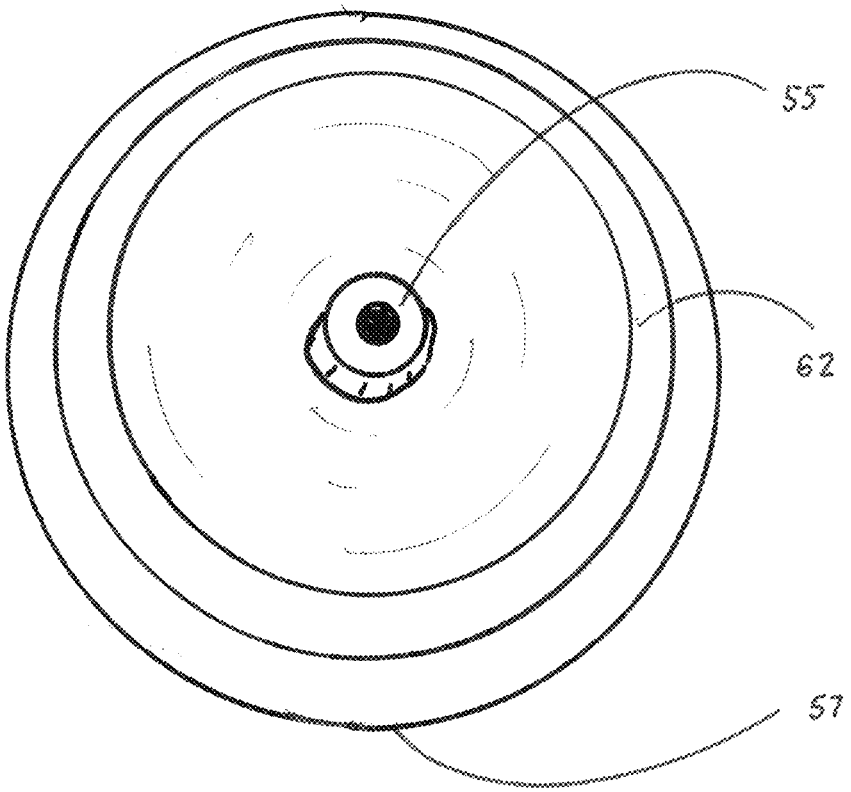
FIG. 2*l* shows an air blast launcher nipple assembly front photographic representation of the apparatus of FIG. 2*j*.
Figure 2M:
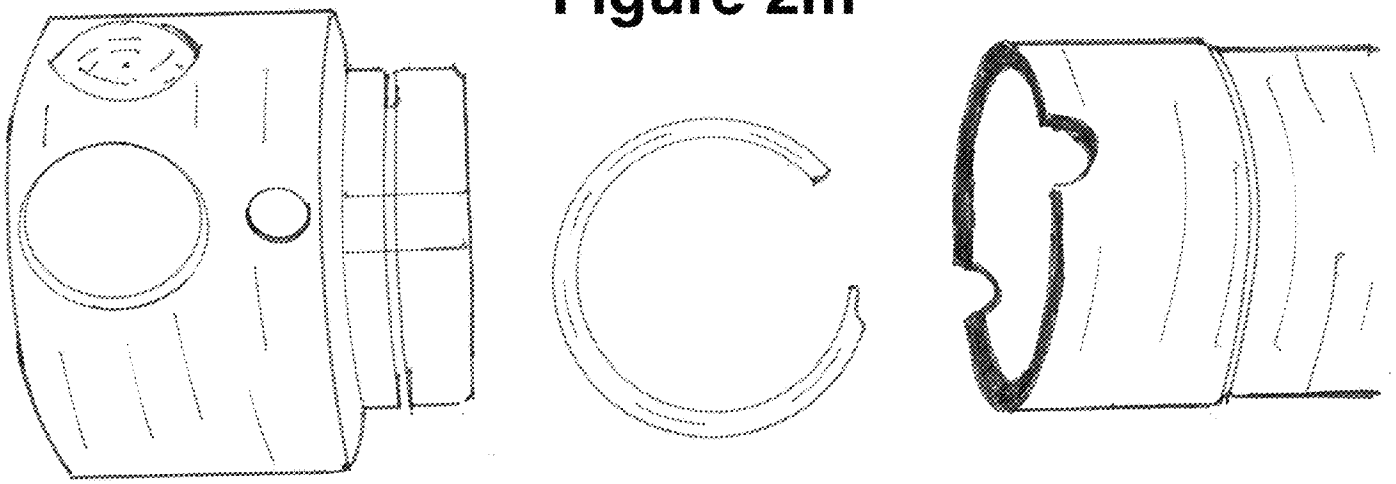
FIG. 2*m* shows close-up photographic representations of portions of the hardware of FIG. 2*i*.
Figure 2N:
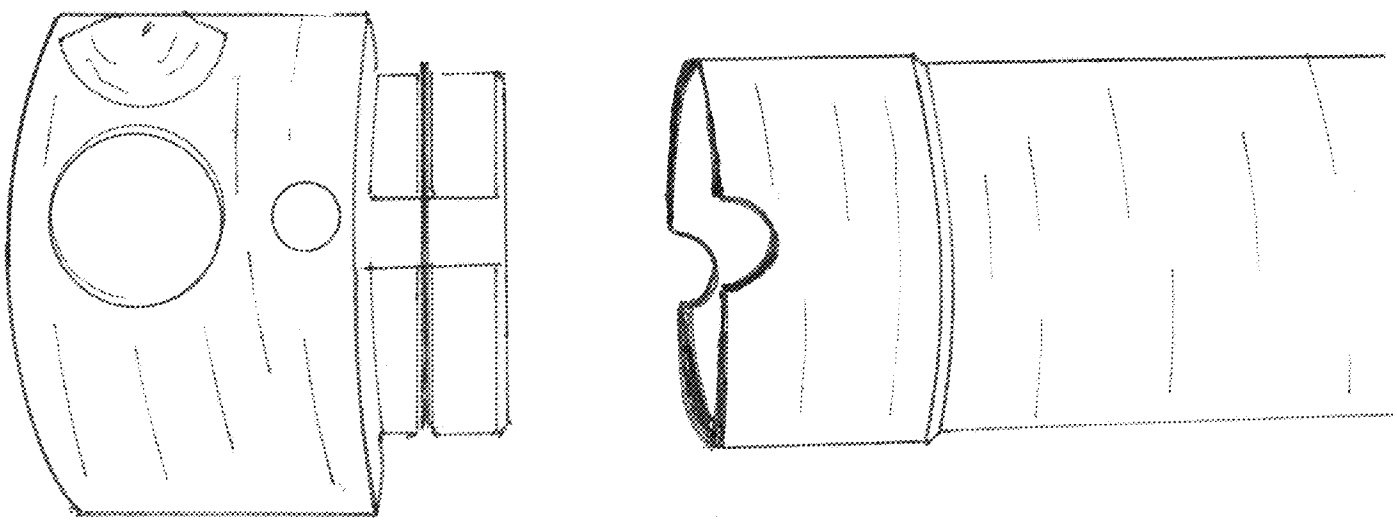
FIG. 2*n* is a photographic representation of the apparatus of FIG. 2*m* with the ring attached.

The nipple mount is retained in a spring retainer 56 with a spring retainer ring 63 mounted in a nipple mount groove 72 to hold a pressure indicating spring assembly 61 in place surrounding the nipple mount. The nipple mount is assembled in a multi diameter passage through a body plug 57. A pressure indicating groove 69 is formed in the nipple mount at a diameter transition between the body of nipple mount and its end used to retain it from forward movement against the back end of the body plug. A spring retainer seal 64, usually an O-ring, is mounted in a body plug seal groove on the body plug, and a spring retainer seal, usually an O-ring, is mounted in a spring retainer groove 71 to seal the nipple assembly to the nozzle assembly during initiation and launching FIG. 2*k* is a photograph of the nipple assembly component from the side. FIG. 2*l* is a photograph of the nipple assembly from the nipple or front side.

Figure 3:
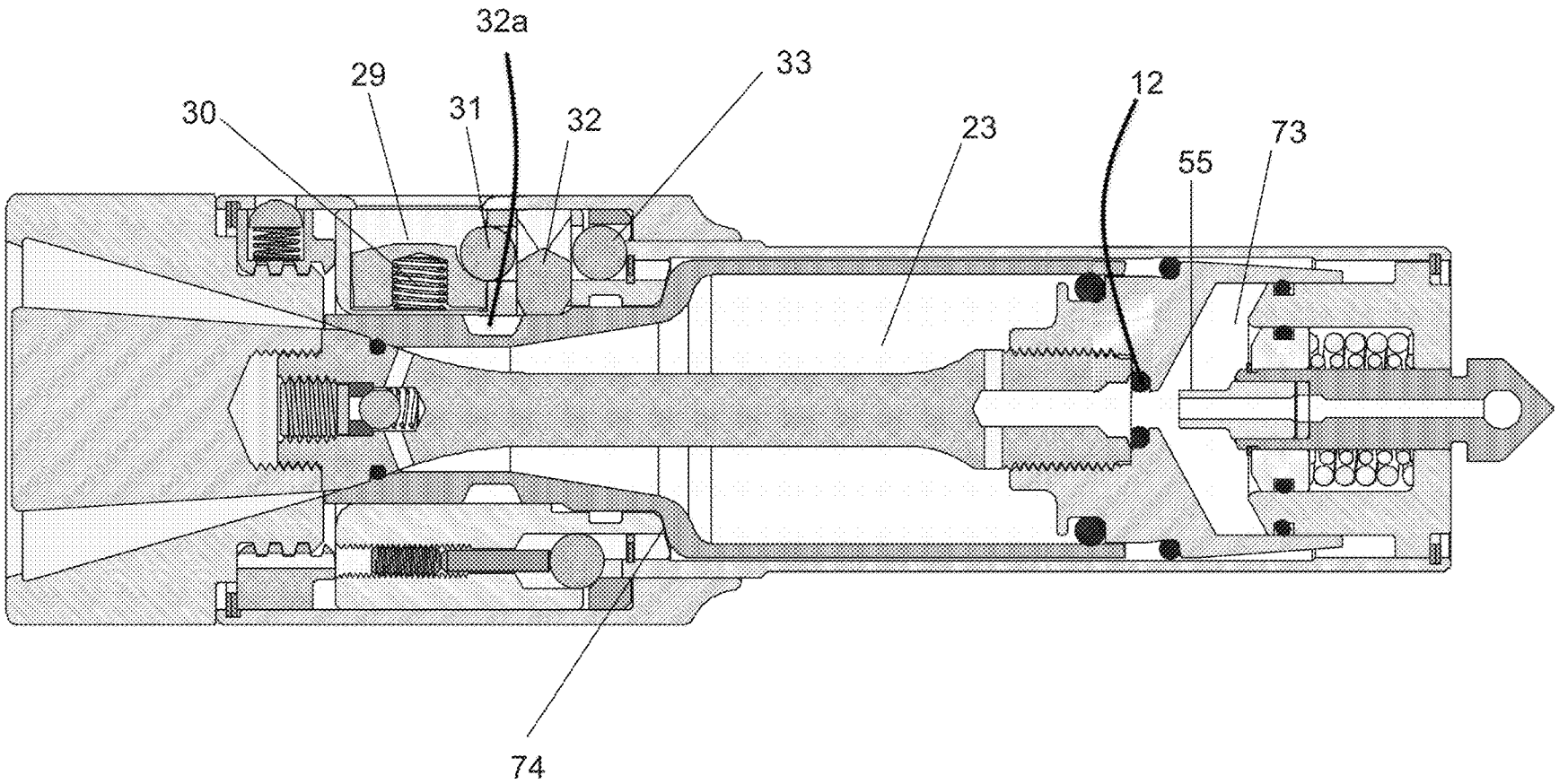
FIG. 3 shows an air blast launcher initiation detailed cross sectional view of the apparatus of FIG. 1 during a first stage of operation.

FIG. 3 shows the initiation sequence of launching or firing the air blast or release of propelling gas with the launcher in the fire position of the safety sleeve. First, the initiation button 29 is pushed all the way down. This releases the initiation ball 31 to move forward into a clearance area in the button. The movement of ball 31 releases the initiation pin 32 which (as best seen in FIG. 1) holds the nozzle assembly back by interference with a groove on the outside of the nozzle assembly (also as best seen in FIG. 1) the location of the pin 32 within the groove or recess 32*a* holds the nozzle assembly 5 against the gas pressure in the charge volume 23 pressing on the initiation nipple 55. The pin 32 is free to move upward (as shown in FIG. 3) and the safety ball 33 can move backward in the barrel assembly when the launcher is on fire position.

As the nozzle assembly 5 moves forward, the gas seal (between the outer diameter of nipple 55 and nipple seal 12) is broken by the relative movement of the initiation nipple to the seal in the nozzle assembly. The gas within charging volume 23 is released in to an initiation volume 73, pressurizing volume 73 and moving nozzle assembly 5 (along with nipple assembly 6), until the nozzle assembly forward motion is stopped by a stop shoulder 74 contacting the back of the barrel 8-74 and the outside of the pressure vessel.

Figure 4:
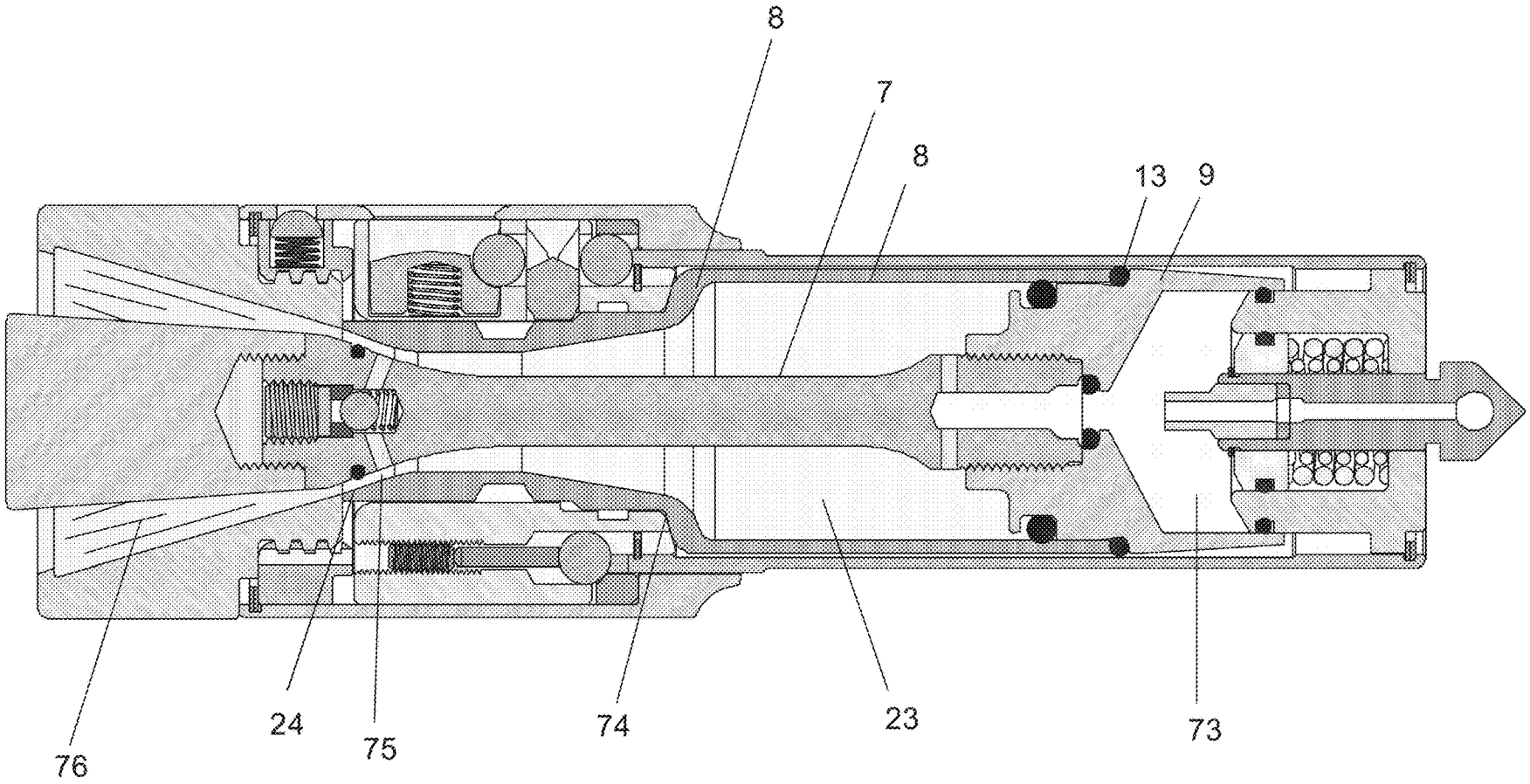
FIG. 4 shows an air blast launcher air blast release detailed cross sectional view of the apparatus of FIG. 1 during a next stage of operation.

FIG. 4 shows the stop shoulder 74 restraining the movement of the nipple assembly and the pressure vessel 8. The gas pressure in the initiation space 73 continues to push on the aft cavity within the valve stop 9 until the stop buffer 13 cushions and stops the relative movement of the nipple assembly 6 and it valve stop 9 against the back of the barrel 8. This relative forward movement of valve stop 9 (to which rod 7 is threadably attached) relative to pressure vessel 8 achieves an open position of the nozzle 24, created between the outer surface of rod 7 and the inner diameter of the pressure vessel 8, releasing the pressurized gas through a nozzle passage 75 and into an expansion passage 76 which speeds up the gas velocity as the pressure is reduced. It is understood that the expansion passage 75 as shown has an increasing annular, cross sectional area in the direction of flow. Since in some embodiments the pressure difference between the gas within charging volume 23 and ambient conditions is sufficient for choked flow, this increasing area can result in an increase in flow velocity, and in some embodiments achieve supersonic exit velocity. However, yet other embodiments of the invention are not so constructed, and the exit nozzle (corresponding to nozzle 24) can be of relatively constant annular cross sectional area, and in some embodiments provide a decreasing annular cross sectional area in the direction of gas flow. In comparing FIGS. 1, 3, and 4, it can be seen that inner flow nozzle 3 extends from a most inward position (FIG. 1) to an intermediate position (FIG. 3), immediately after initiation but before valve stop 9 is propelled toward pressure vessel 8. FIG. 4 shows a final, at rest condition in which the end of inner flow nozzle 3 extends out beyond the end of outer flow nozzle 2 (and also past sharp edge 1).

Figure 5:
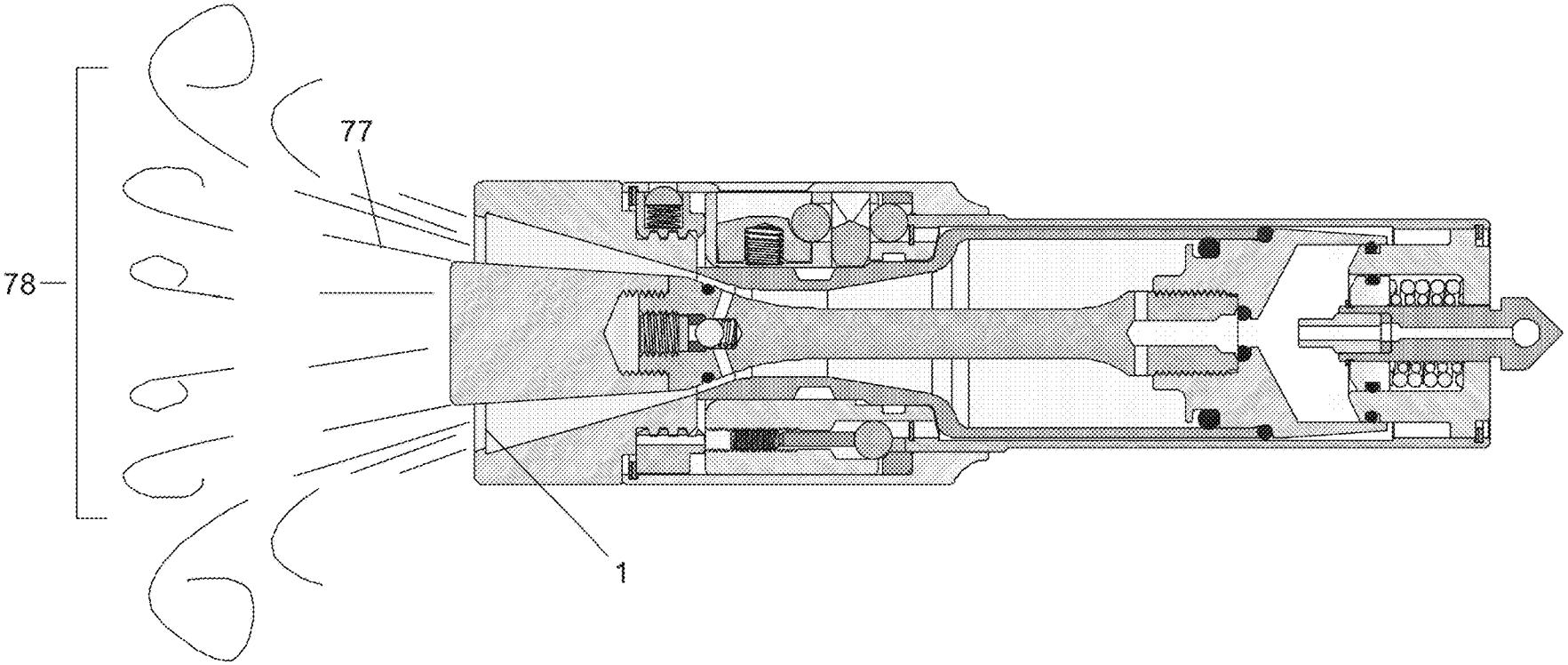
FIG. 5 shows an air blast launcher air blast ring vortex created detailed cross sectional view of the apparatus of FIG. 1 during a next stage of operation.

FIG. 5 shows a device according to another embodiment Air Blast Ring Vortex Created Detail as the gas at high velocity passes the sharp edge 1. Turbulence is created slowing the outer cone of the gas escaping the launcher while the inner core of the gas remains at higher differential velocity. This action creates a ring vortex which travels to the target and the escaping gas at supersonic velocity creates a loud sound.

Figure 6:
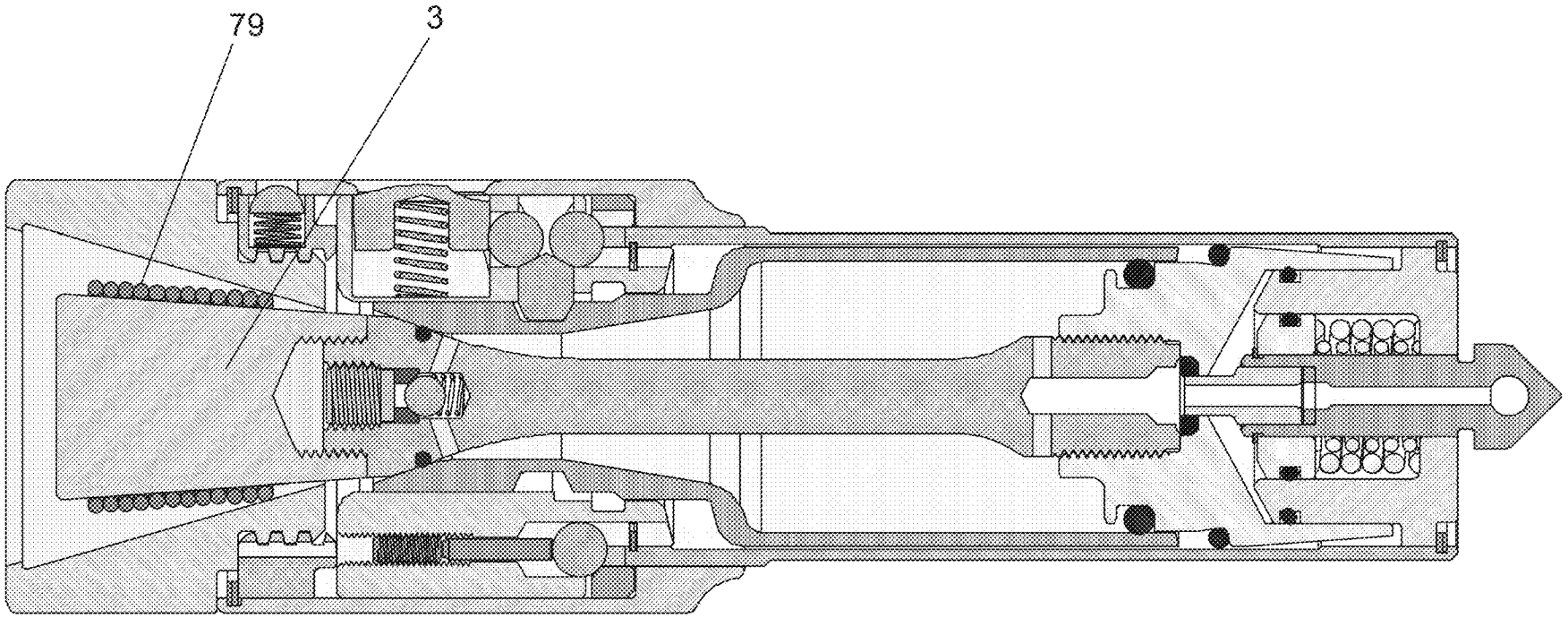
FIG. 6 shows an air blast launcher Ultra Low Mass Projectile (ULMP) Oring detailed cross sectional representation of an apparatus according to another embodiment of the present invention.

FIG. 6 shows a device according to another embodiment ULMP O-ring Detail the installation of an O-ring Ultra Low Mass Projectile on the inner flow nozzle 3 to create an accessory attachment transforming the launcher into an ultra-low mass projectile launcher.

Figure 7:
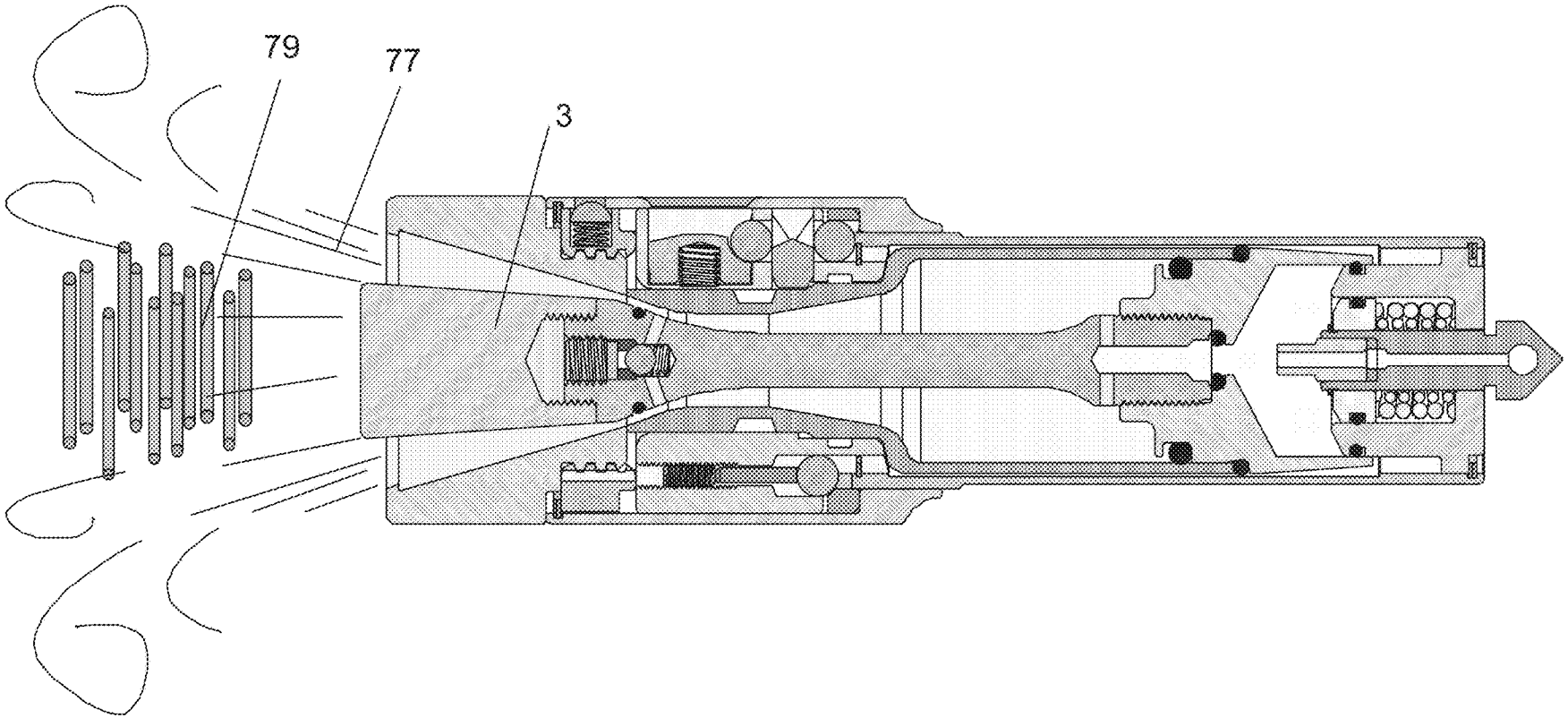
FIG. 7 shows an air blast launcher ULMP Oring launch detailed cross sectional line drawing of the apparatus of FIG. 6 during a next stage of operation.

FIG. 7 shows the device of FIG. 6 when operating as an ultra-low mass projectile launcher using O-rings. Upon launching the air blast a straight gas flow 77 surrounds and flows of the end of the inner flow nozzle expelling the one or more O-rings mounted to it at high velocity creating a non-lethal ultra low mass blunt trauma projectile(s).

Figure 8:
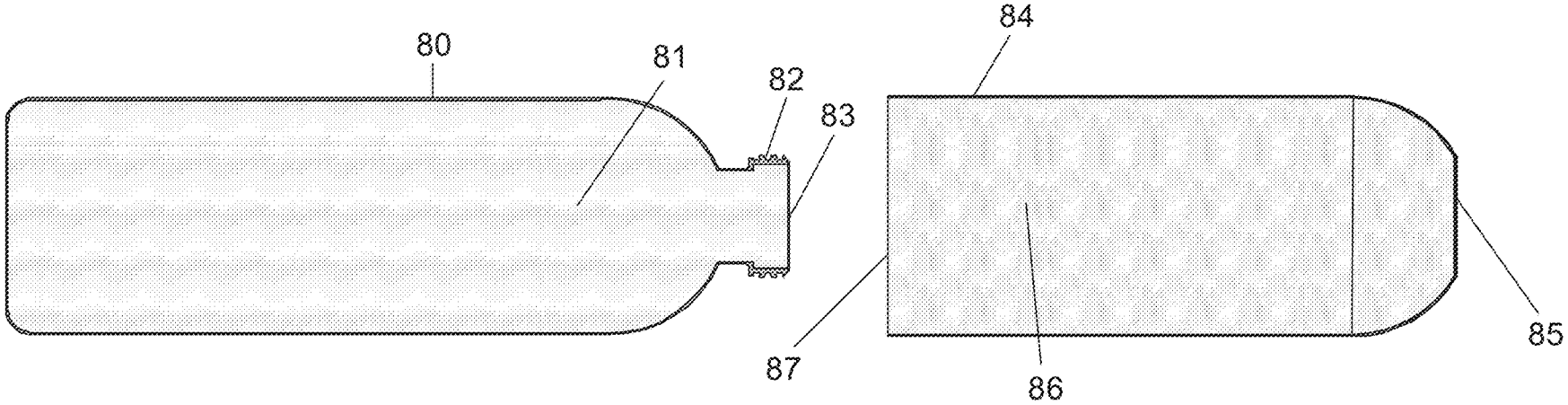
FIG. 8 shows a water mist attachment bottle and sleeve detailed cross sectional line drawing of an apparatus according to another embodiment of the present invention.
Figure 9:
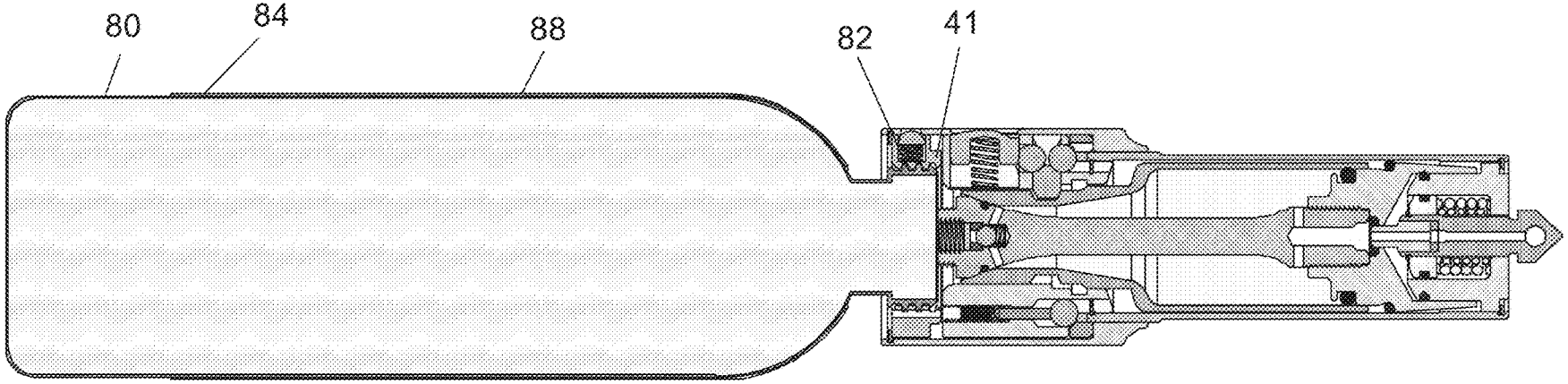
FIG. 9 shows a water mist launcher attachment on an air blast launcher detailed cross sectional line drawing of an apparatus according to another invention, in cross sectional view taken through a longitudinal axis of symmetry.

FIG. 8 shows a device according to another embodiment Attachment Bottle and Sleeve Detail the components consisting of a standard water bottle 80 that surrounds a water space 81 and has an attachment thread 82 for attaching to the device. Membrane seal 83 covers the bottle opening when the bottle cap is removed. Alternatively, a frangible seal could also be mounted to the weapon. The bottle fits into a bottle support sleeve 84, the interior of which is a structural support space 86 for the bottle and has a bottle mount passage allowing for installation completely over the bottle with an bottle neck passage 85. Sleeve 84 reinforces the water bottle along most of its length, but leaves open the end. With this strengthening, it is more likely that the over pressurization of the bottle (during weapon firing) will rupture the forwardmost end only.

Figure 8D:
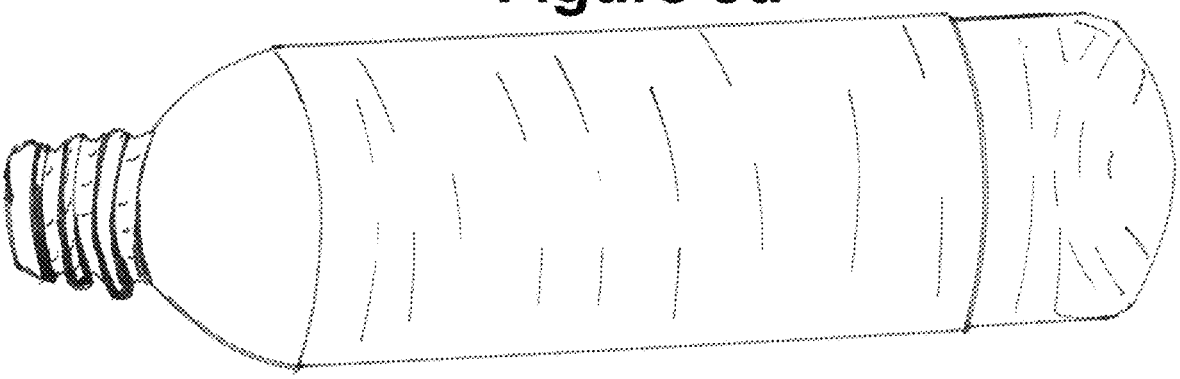
FIG. 8*d* shows a water mist launcher attachment water bottle in sleeve photographic representation, useful in the apparatus of FIG. 8.
Figure 8E:
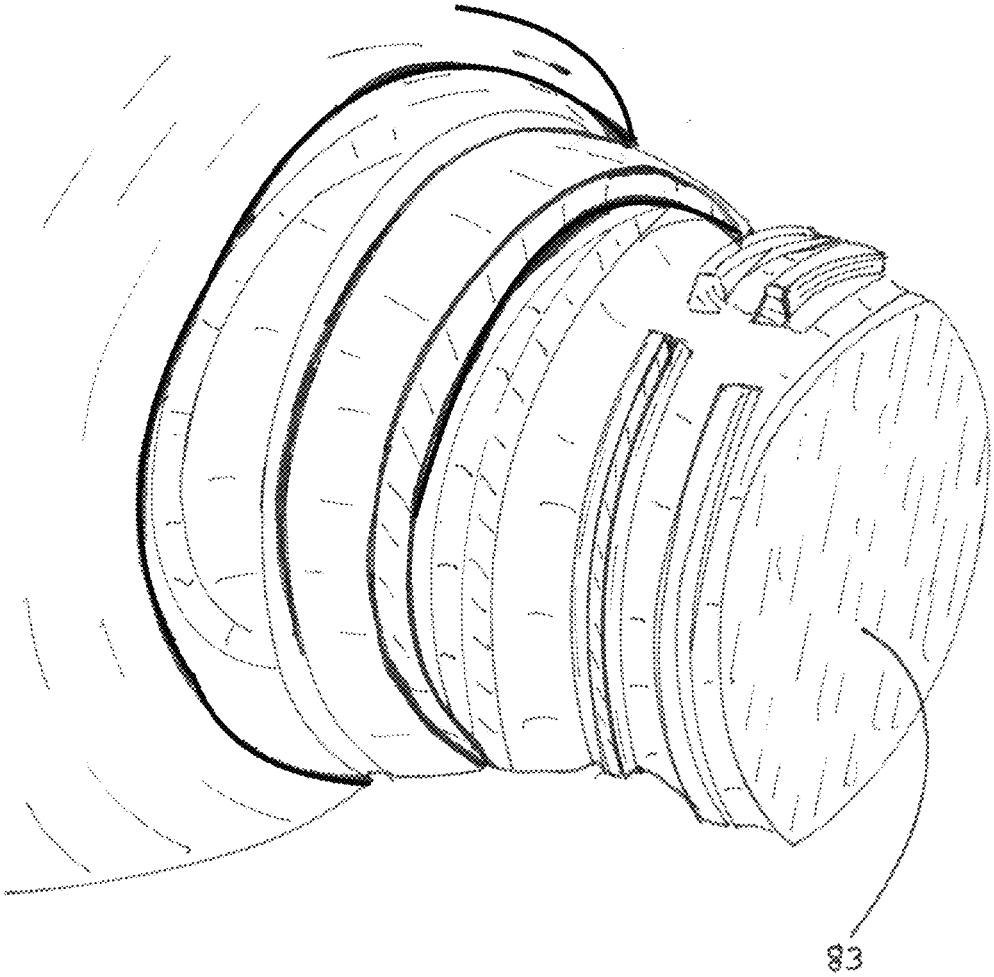
FIG. 8*e* shows a water mist launcher attachment bottle membrane seal photographic representation, useful in the apparatus of FIG. 8.
Figure 9C:
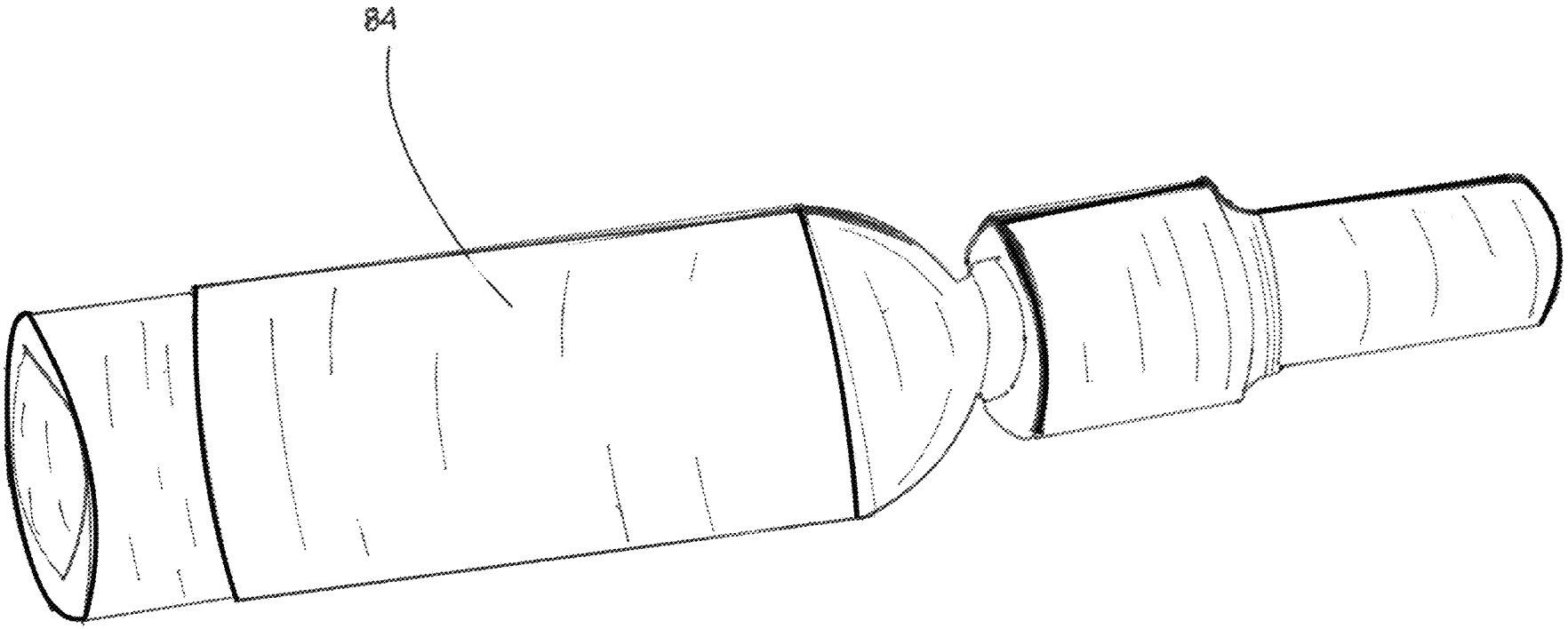
FIG. 9*c* shows a water mist launcher attachment Installation on the air blast launcher photographic representation of the apparatus of FIG. 9.

FIG. 8*d* shows a device according to another embodiment Launcher Attachment Water Bottle in Sleeve, and shows a photo of the water mist attachment. FIG. 8*e* shows a device according to another embodiment Launcher Attachment Bottle Membrane Seal, and shows a photo of a membrane seal on the bottle.

FIGS. 9, 9*c*, 10, 11, and 12 show a device according to another embodiment of a Launcher Attachment on a bottle 80. Support sleeve 84 is attached with the thread 82 to the attachment mount 41 of the front of the weapon.

Figure 10:
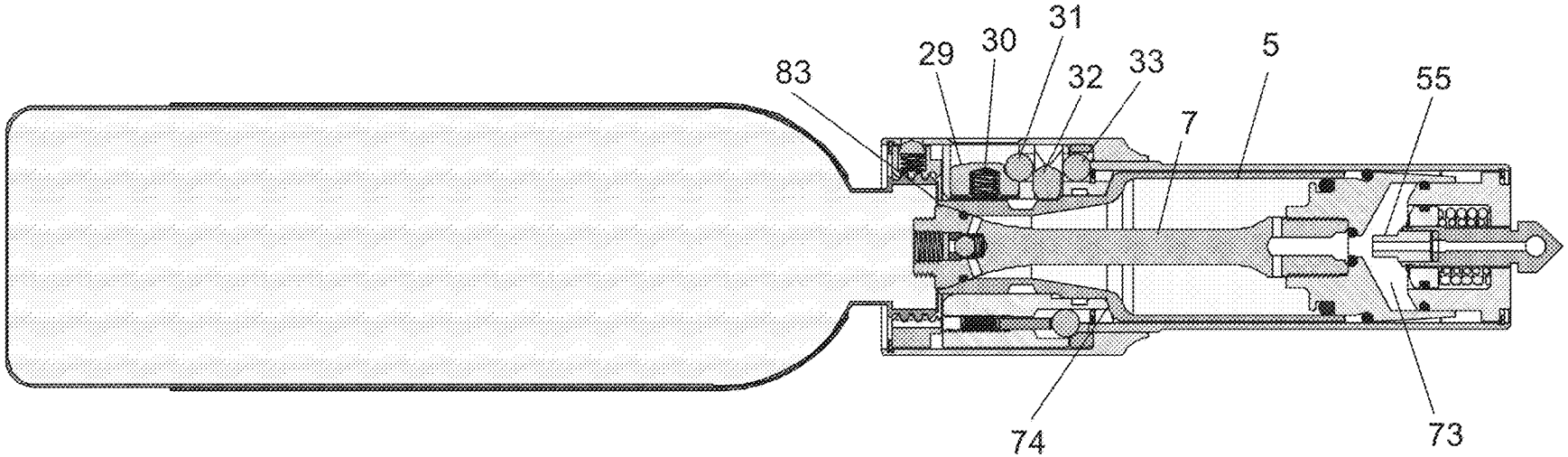
FIG. 10 shows a water mist launcher attachment on the air blast launcher initiation detailed cross sectional view of the apparatus of FIG. 9 shown during the next stage of operation.

FIG. 10 shows a device according to another embodiment Launcher Attachment mounted on the weapon. Initiation Detail show the initiation sequence of launching or firing the water mist upon the release of propelling gas with the launcher in the fire position of the safety sleeve. First the initiation button 29 is pushed all the way down. This releases the initiation ball 31 to move forward into a clearance area, whereupon the movement of the ball releases the initiation pin 32 which holds the pressurized assembly back by interface with a groove on the outside of the pressurized assembly against the gas pressure in the initiation volume 73 and pressing on the initiation nipple 55. The pin is free to move as the safety ball 33 can move backward in the barrel assembly when the launcher is on fire position. As the pressurized assembly moves forward the gas seal is broken by the relative movement of the initiation nipple to the mating seal in the nozzle assembly, and the gas is released in to the initiation volume 73, pressurizing it and moving and translating it forward until the pressurized assembly is stopped by a stop shoulder 74 on the back of the barrel and the outside of the pressure vessel as the forwardmost end of the rod pierces the membrane seal 83. Alternatively, some embodiments include a rupturable membrane seal that is broken apart by gas pressure being released from the pressure vessel.

Figure 11:
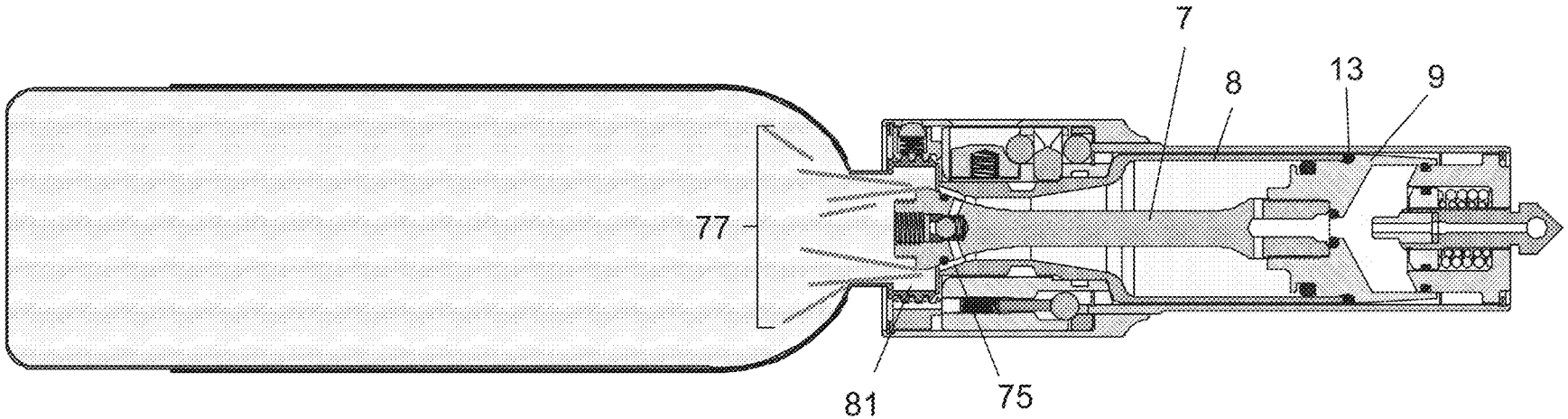
FIG. 11 shows a water mist launcher attachment on the air blast launcher air blast release detailed cross sectional view of the apparatus of FIG. 9 shown during the next stage of operation.

FIG. 11 shows a device according to another embodiment Launcher Attachment on The device Air Blast Release Detail. Flowing from the pressure vessel 8 is the gas pressure in the initiation space 73 pushes on the valve stop 9 until the stop buffer 13 cushions and stops the movement of the valve stop against the back of the barrel. This shows the open position of the nozzle and the valve rod 7, releasing the pressurized gas through a nozzle passage 75 into the water space 81 by the straight gas flow 77 under pressure to mix with the water in the bottle.

Figure 12:
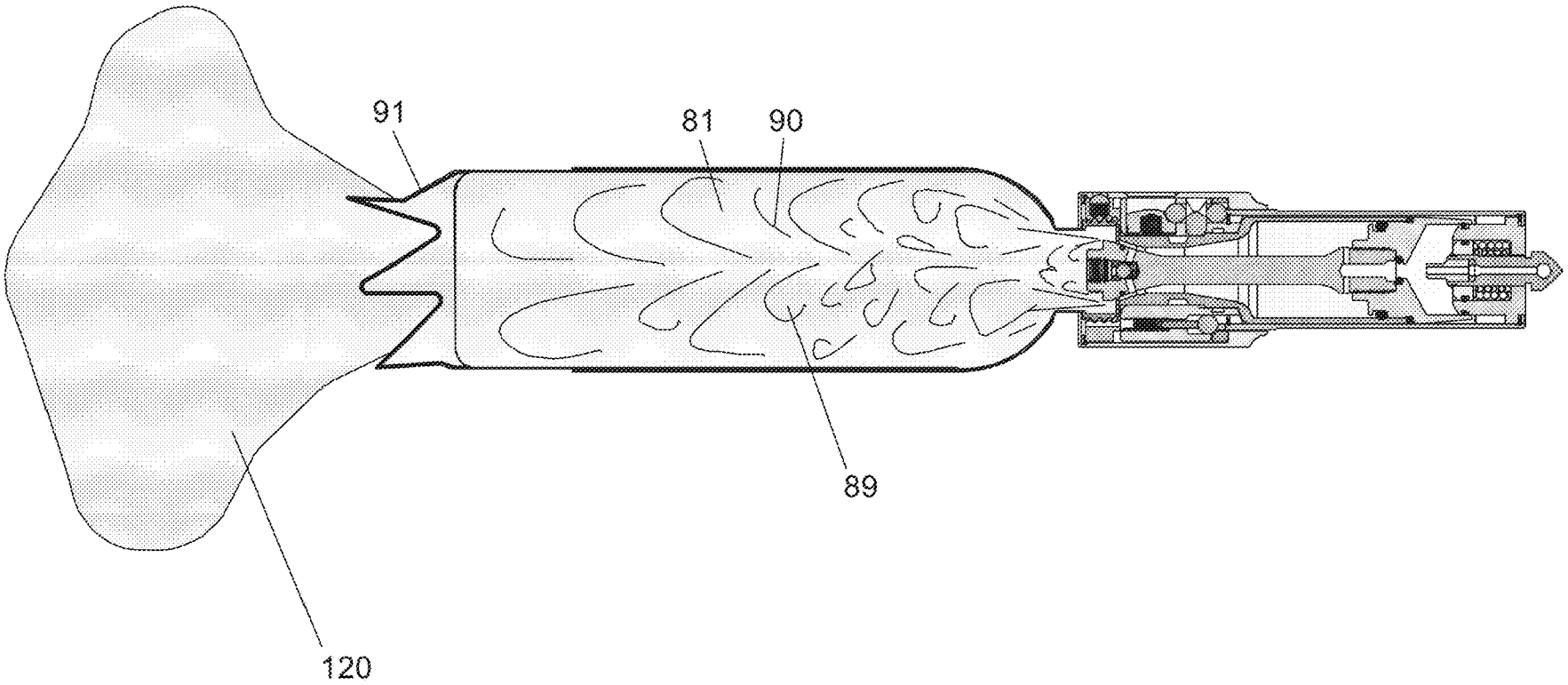
FIG. 12 shows a water mist launcher attachment on the air blast launcher water mist launch detailed cross sectional view of the apparatus of FIG. 9 shown during the next stage of operation.

FIG. 12 shows the device of FIGS. 10 and 11. The pressure and flow of the air creates turbulent flow 90 in the water space 81 creating an aerated water 89 effect until the bottle bottom 91 splits open releasing the water mist projectile 121.

Figure 12A:
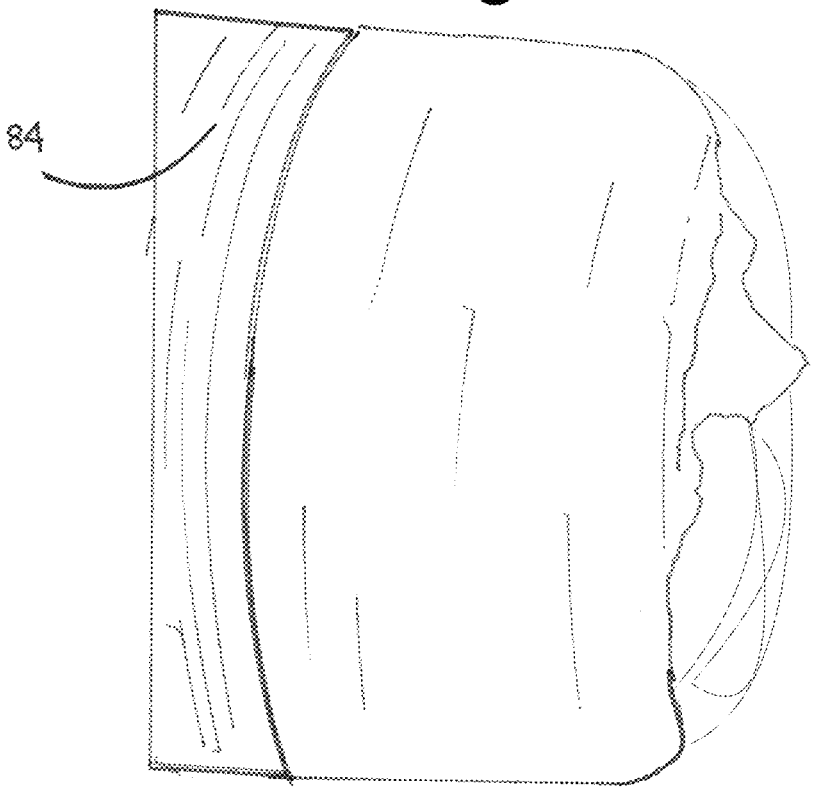
FIG. 12*a* shows a water mist launcher attachment ruptured bottle bottom side photographic representation of a portion of the apparatus of FIG. 12 after operation.
Figure 12B:
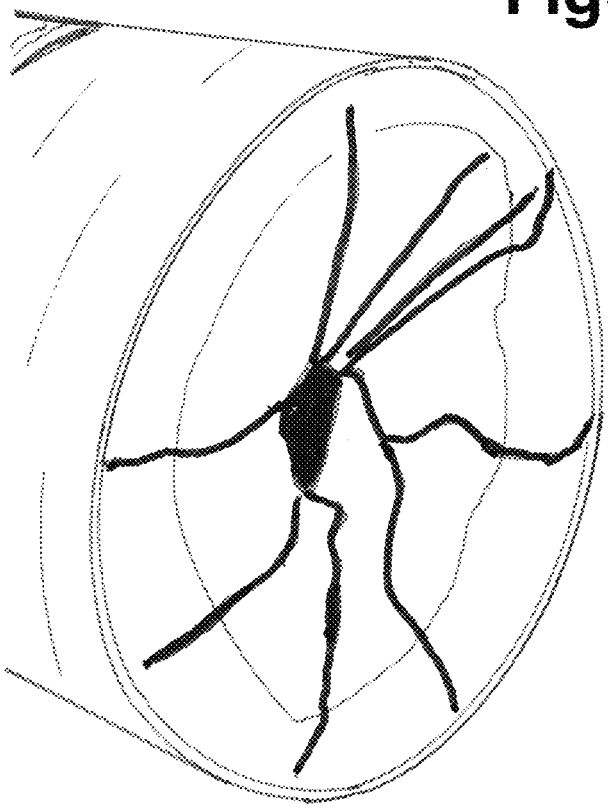
FIG. 12*b* shows a water mist launcher attachment ruptured bottle bottom front photographic representation of a portion of the apparatus of FIG. 12 after operation.

FIG. 12*a* shows a device according to another embodiment Launcher Attachment Ruptured Bottle Bottom Side shows a photograph of the bottle bottom split aft the launch of the water. FIG. 12*b* shows a device according to another embodiment Launcher Attachment Ruptured Bottle Bottom Front shows the end of the bottle bottom with splits.

Figure 13A:
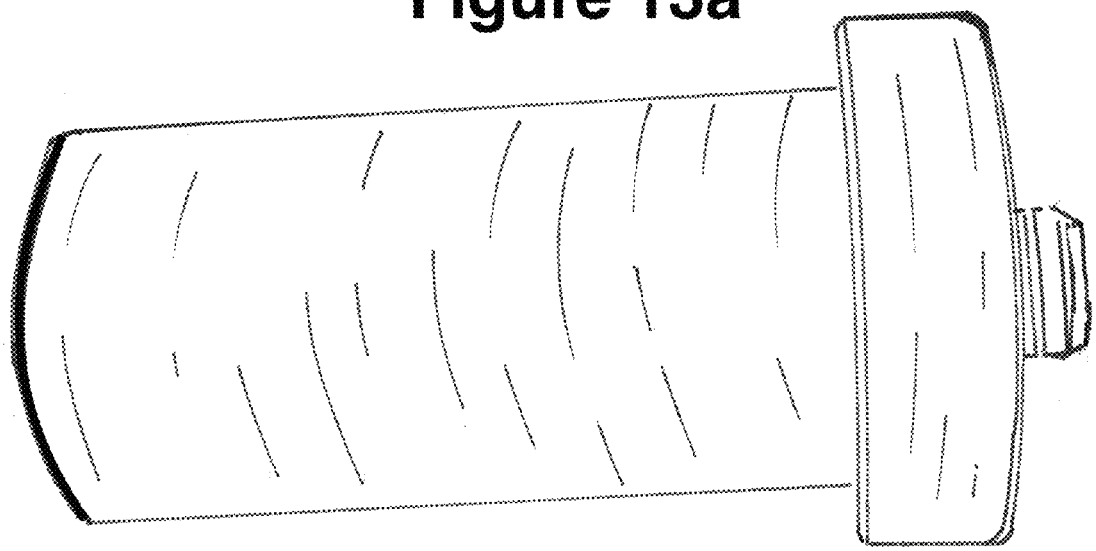
FIG. 13*a* shows a water mist launcher attachment aluminum billet sleeve side photographic representation of an apparatus according to another embodiment of the present invention.
Figure 13B:
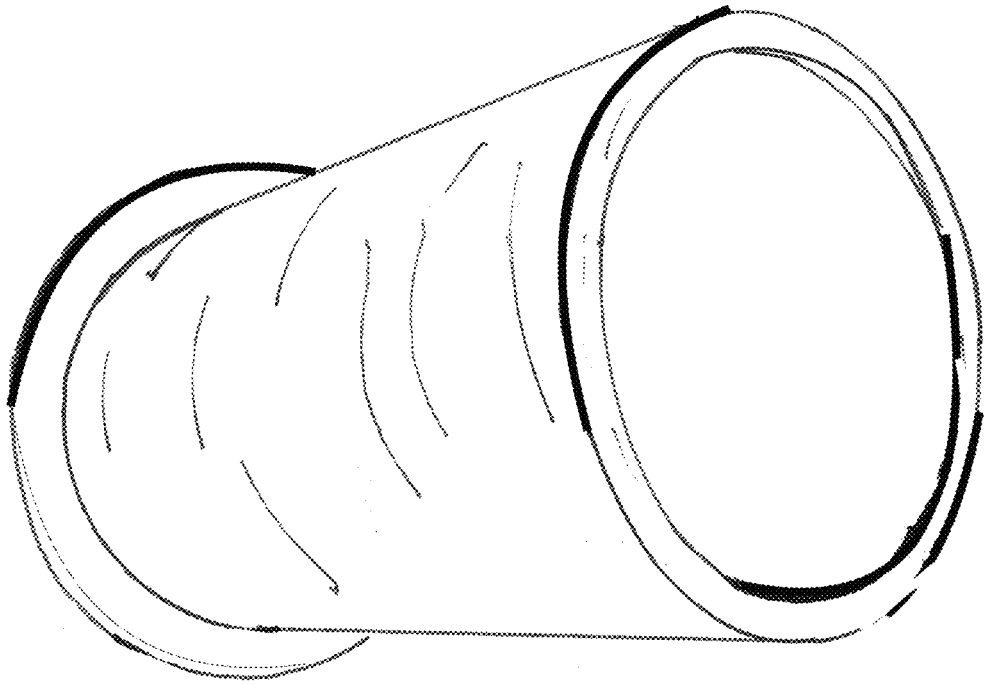
FIG. 13*b* shows a water mist launcher attachment aluminum billet sleeve front photographic representation of an apparatus according to another embodiment of the present invention.

FIG. 13*a* shows a device according to another embodiment, a Launcher Attachment Aluminum Billet Sleeve. FIG. 13*a* is a side view of the support sleeve 84 for the water mist launcher attachment. FIG. 13*b* shows a device according to another embodiment Launcher Attachment Aluminum Billet Sleeve Front and view.

Figure 13D:
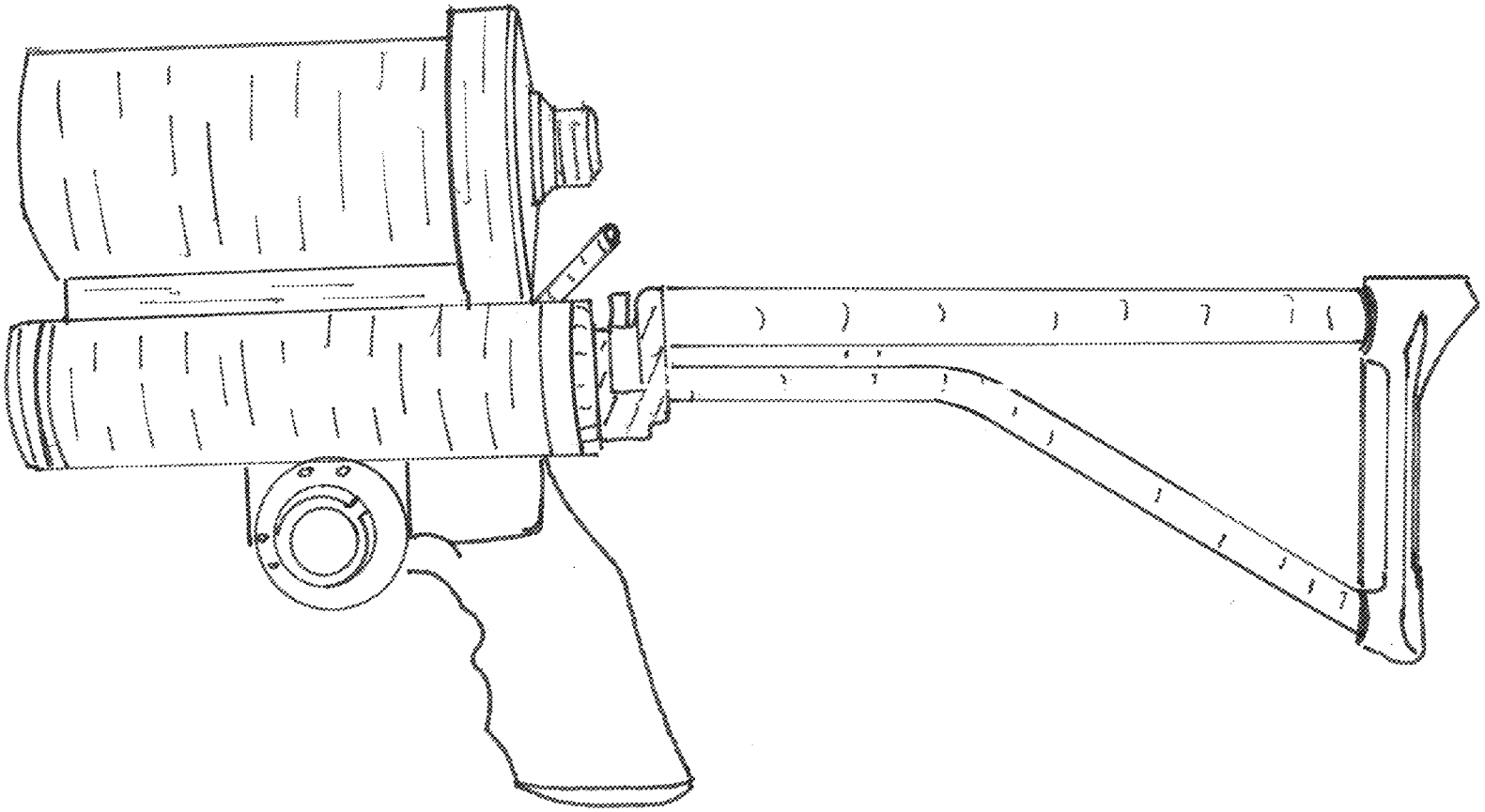
FIG. 13*d* shows a water mist launcher attachment aluminum billet sleeve with shoulder mounting side photographic representation of the apparatus of FIG. 13*a* combined with an apparatus according to another embodiment of the present invention.
Figure 13E:
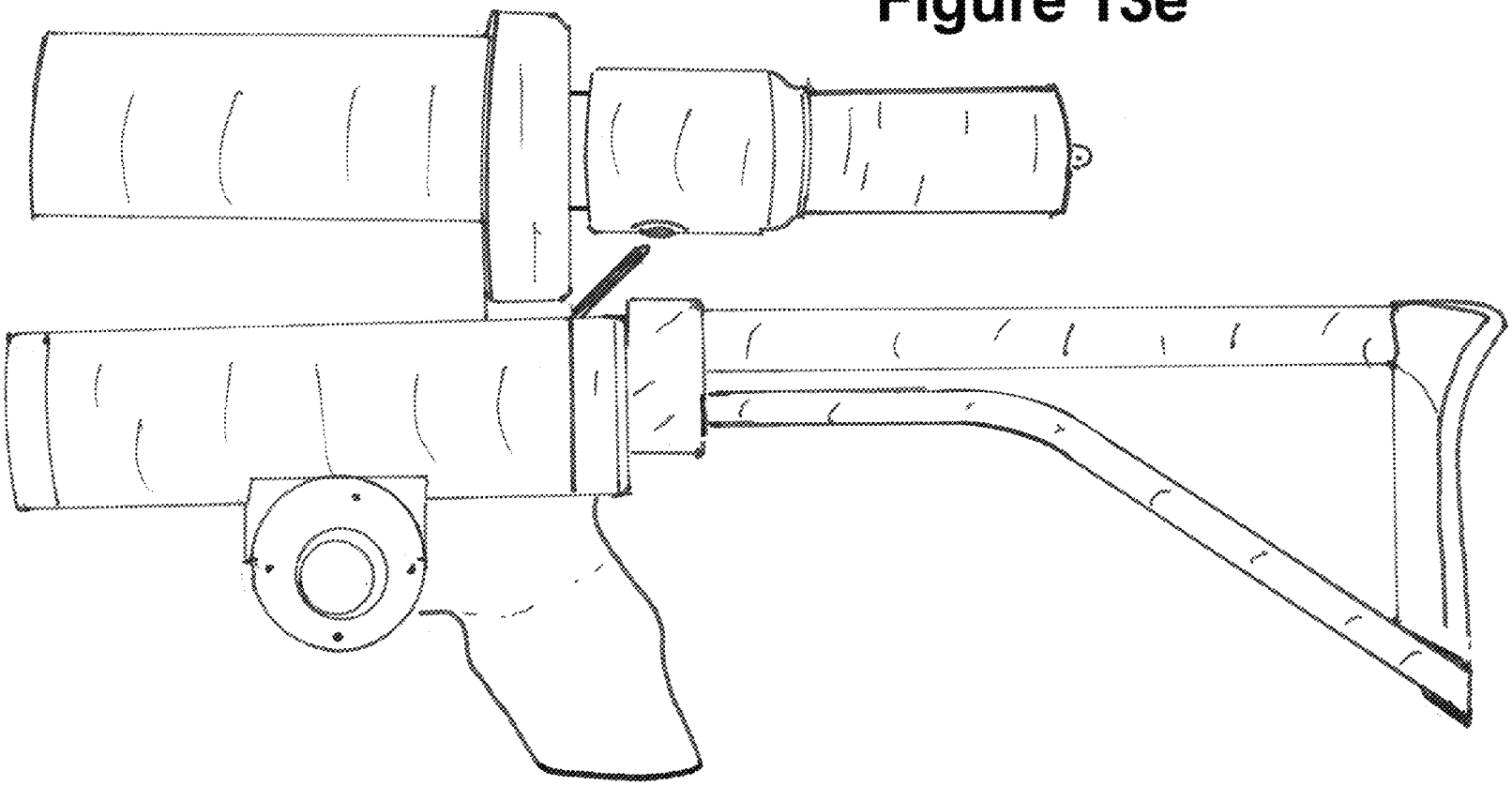
FIG. 13*e* shows a water mist launcher attachment aluminum billet sleeve with shoulder mounting with the air blast launcher side photographic representation of the apparatus of FIG. 13*d* combined with an apparatus according to another embodiment of the present invention.
Figure 13F:
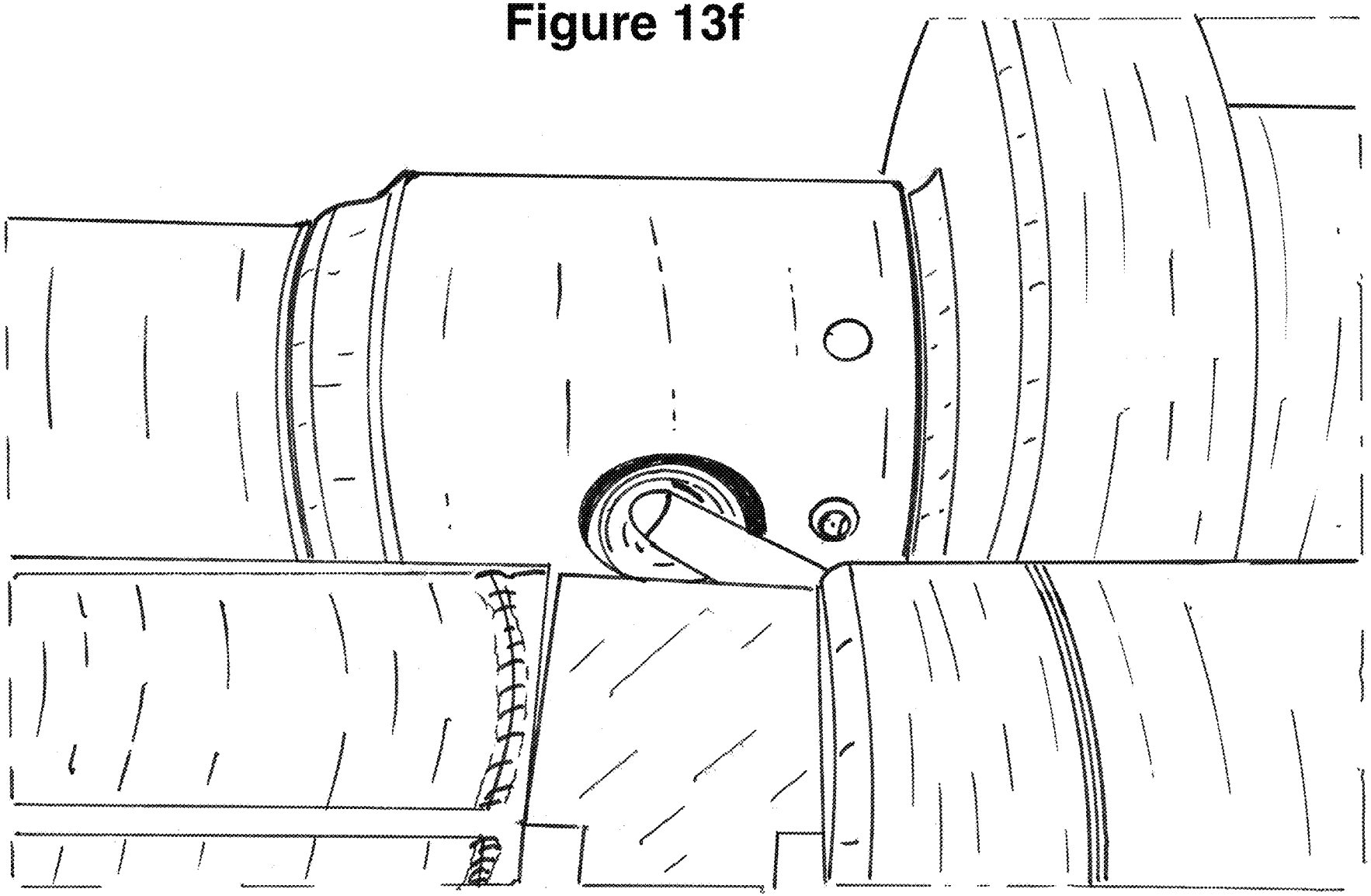
FIG. 13*f* shows a water mist launcher attachment aluminum billet sleeve with shoulder mounting with the air blast launcher trigger detailed photographic representation of a portion of the apparatus of FIG. 13*e*.

FIG. 13*d* shows a device according to another embodiment Launcher Attachment Aluminum Billet Sleeve with Shoulder Mounting Side shows a photograph of an embodiment of the water mist attachment accessory for use with a shoulder mounting means. The container for the water bottle is shown mounted above a cylinder, to which is attached a vertical hand grip immediately behind a trigger. The trigger extends upward and contacts the firing button of the weapon when installed (as best seen in FIG. 13*f*). FIGS. 13*d* and 13*e* also show a shoulder stock.

FIG. 13*e* shows a device according to another embodiment Launcher Attachment Aluminum Billet Sleeve with Shoulder Mounting with a The device Side view shows a photograph of the shoulder mount accessory with the launcher attached.

FIG. 13*f* shows a device according to another embodiment Launcher Attachment Aluminum Billet Sleeve with Shoulder Mounting with The device Trigger Detail shows a photograph of the shoulder mount attachment and the triggering rod interface with the initiation button of the launcher.

Figure 14:
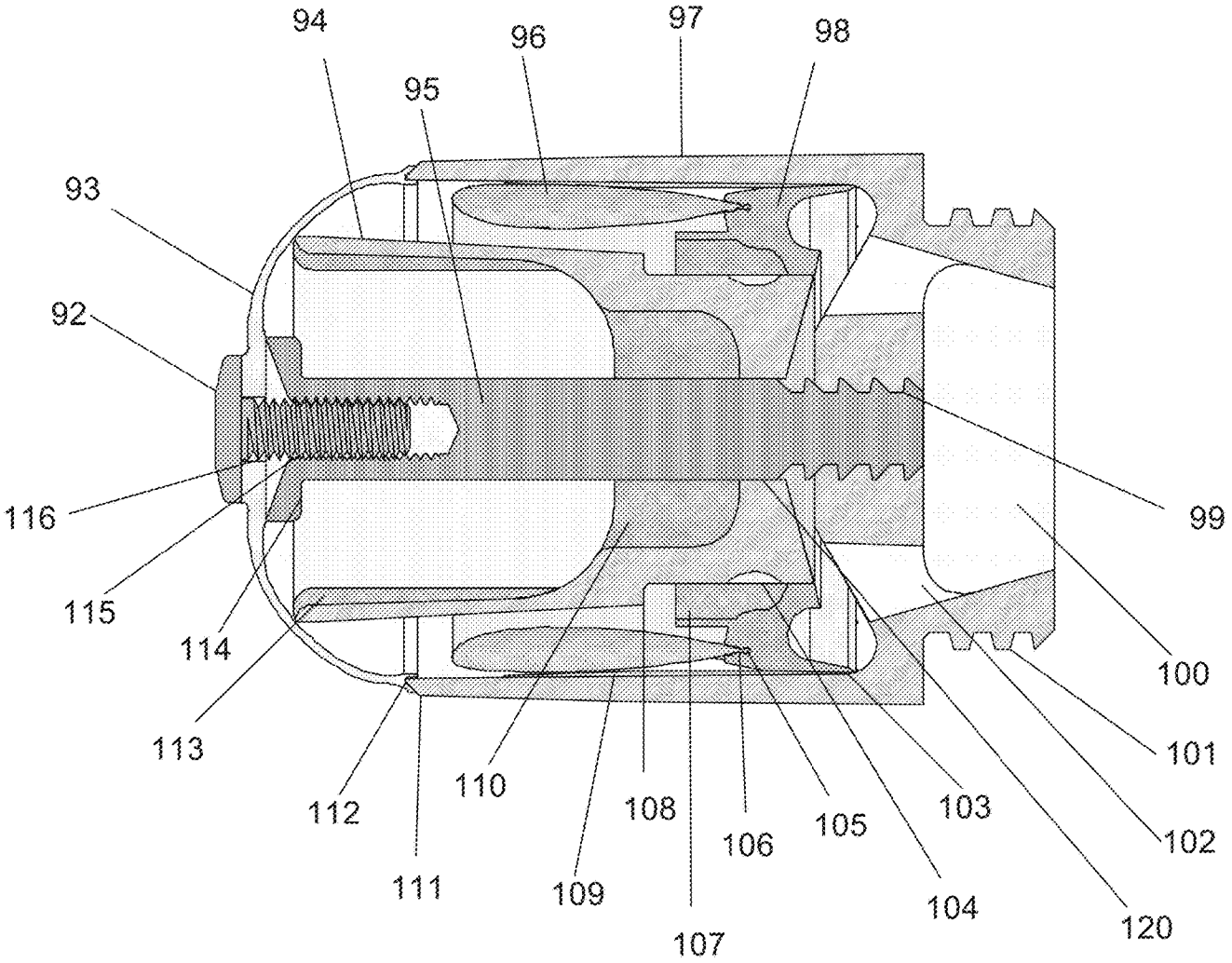
FIG. 14 shows a ULMP ring airfoil attachment detailed cross sectional line drawing taken down the centerline of an apparatus according to another embodiment of the present invention.

FIG. 14 shows a device according to another embodiment Attachment Detail shows a mounting casing 97 usually made of structural plastic which has an attachment mounting thread 101 for attaching to the device which surrounds an inlet flow director 100 for directing the gas flow from the launcher to power the attachment through at least one inlet flow passage 102 though the casing. The gas then is released behind an outer sabot 98 mounted surrounding and able to slide on an inner sabot 94 and has at least one outer sabot stop rib 107 at the forward end interface between the sabots. The outer sabot stop rib(s) is limited in its forward movement by an outer sabot stop shoulder 108 on the inner sabot and retained the aft end of the outer sabot is retained at the aft interface of the inner sabot by a tight interference fit with the inner sabot and a seal lip 103 of the outer sabot interfacing with the end of the inner forward recess in the casing within such recess is travels and seals to in operation. The forward travel of the outer sabot in relation to the inner sabot uncovers a pressure release passage of the inner sabot to relieve propelling gas pressure when the outer sabot reaches the stop shoulder after the device is actuated by a propelling gas in order to safely release the gas and the shape of the outer sabot safety directs the released gas in the direction of a ring airfoil glider projectile 96 removably attached to the outer sabot by at least one projectile snap groove on the tail of the airfoil which tail and groove fit into a projectile mount snap groove 105 on the outer sabot wherein it is supported by the groove and retained by the interface of the groove the airfoil tail so to prevent its release form the outer sabot and hold it in place radially on the sabot as the sabot is rotated by the action of gas pressure on the seal lip of the sabot rotating the sabot as it moves along at least one rifling 109 land on the inner surface of the casing. The inner sabot is mounted on a guide rod 95 through an inner sabot rod passage 120 through the center of the inner sabot and at least on inner sabot stop rib 110. The rod mounts to the casing with a rod mounting means alternatively a screw thread or molded in shoulder configuration between the rod and casing the forward end of the rod has rod stop shoulder 114 either built in as shown in the drawing or as a separate washer which in either case a nose cover 93 forward of the shoulder the nose cover is closely attached to the rod by a stop screw 92 passing through a nose cover mounting passage 116 in the nose cover. The stop screw is affixed to the rod with a thread or alternatively other strong attachment means may be used such as a rivet or welded connection without used of screw threads to affix the retaining means like the stop screw or rivet in place. The stop shoulder on the rod retains the movement of the inner sabot forward and the inner sabot is retained during non-operation by at least one folding ridge 113 by the cover.

Figure 15:
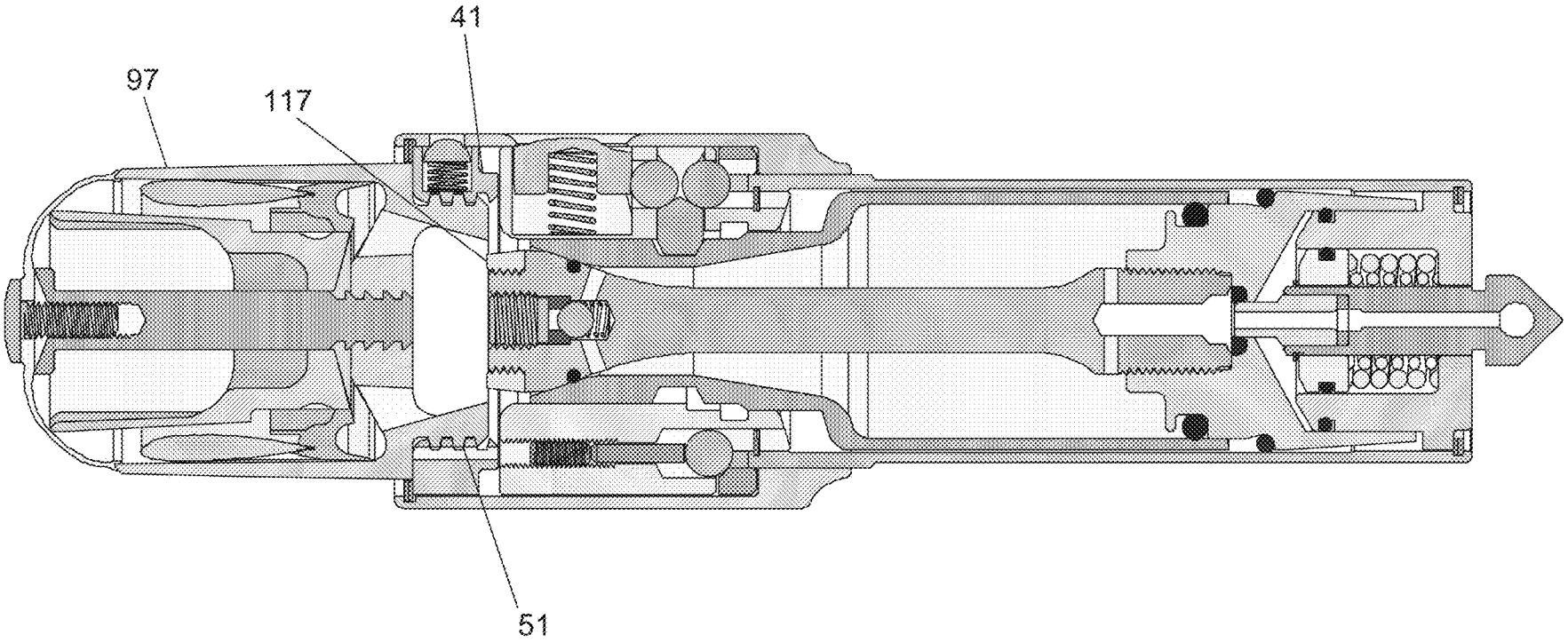
FIG. 15 shows a ULMP ring airfoil attachment on the air blast launcher detailed cross sectional line drawing of the apparatus of FIG. 14 attached to an apparatus according to another embodiment of the present invention.

FIG. 15 shows a device according to another embodiment Attachment on The device Detail the attachment is mounted by the mounting case 97 completely up against the attachment mount 41 of the launcher with the screw attachment thread 51 interface and a rod flow director 117 is installed on the valve rod for use of the attachment.

Figure 16:
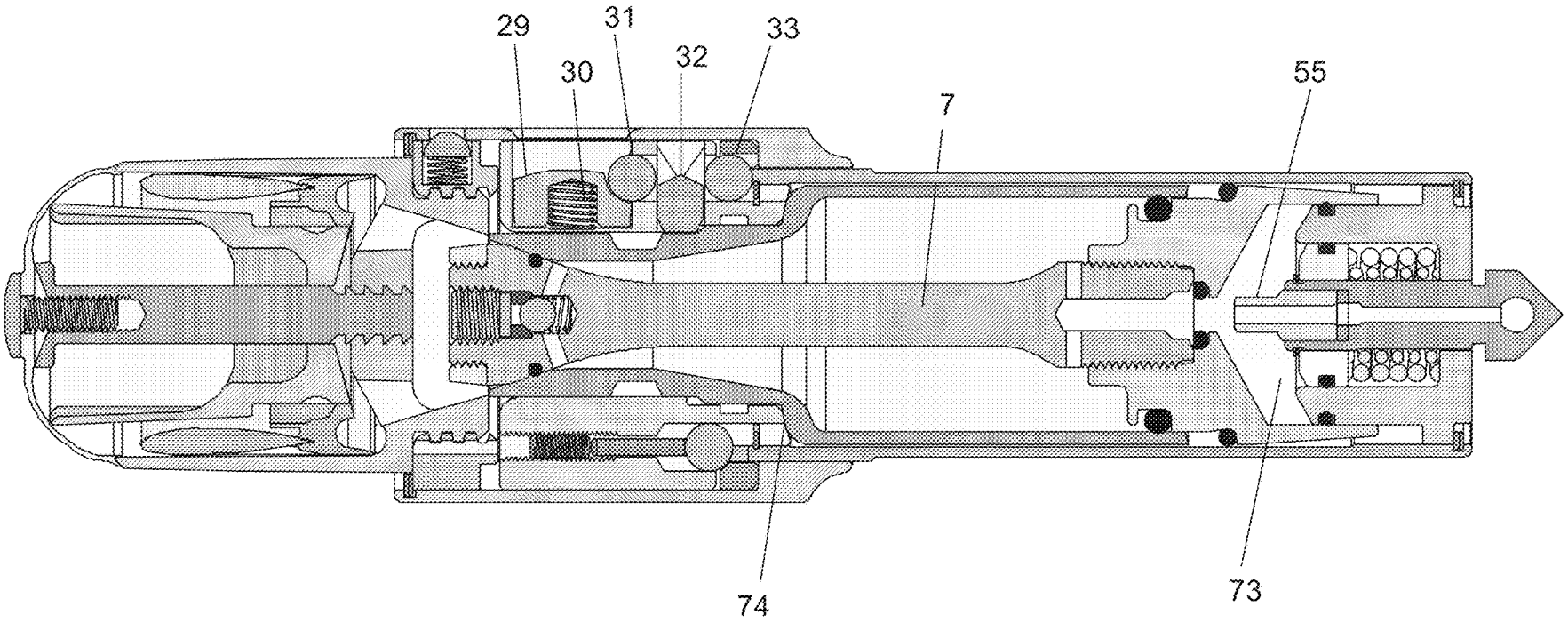
FIG. 16 shows a ULMP ring airfoil attachment on the air blast launcher initiation detailed line drawing of the apparatus of FIG. 15 during a next stage of operation.

FIG. 16 shows a device according to another embodiment Attachment on The device Initiation Detail shows the initiation sequence of launching or firing the air blast or release of propelling gas with the launcher in the fire position of the safety sleeve. First the initiation button 29 is pushed all the way down this releases the initiation ball 31 to move forward into a clearance area in the button whereupon the movement of the ball releases the initiation pin 32 which holds the nozzle assembly back by interface with a groove on the outside of the nozzle assembly against the gas pressure in the charge volume pressing on the initiation nipple 55. The pin is free to move as the safety ball 33 can move backward in the barrel assembly when the launcher is on fire position. As the nozzle assembly moves forward the gas seal is broken by the relative movement of the initiation nipple to is mating seal in the nozzle assembly and the gas is released in to an initiation volume 73 pressurizing it until the nozzle assembly is stopped by a stop shoulder 74 on the back of the barrel and the outside of the pressure vessel.

Figure 17:
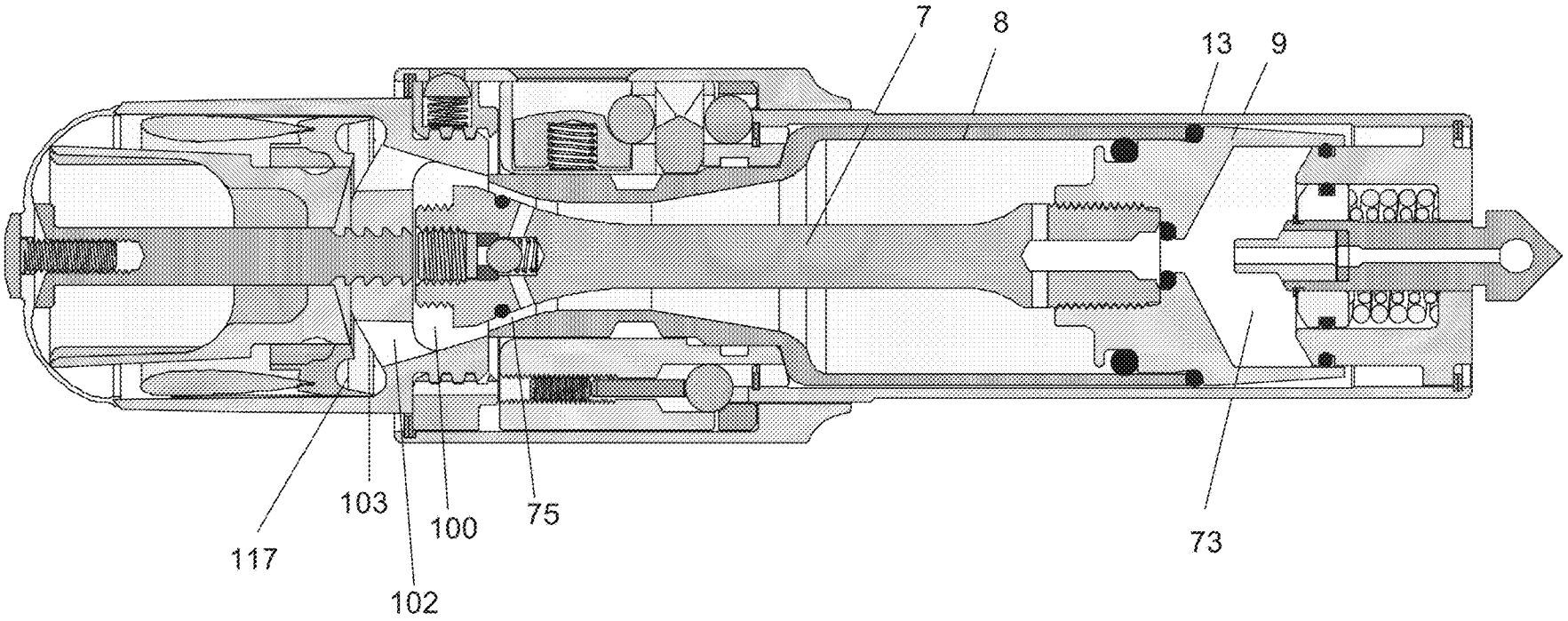
FIG. 17 shows a ULMP ring airfoil attachment on the air blast launcher air blast release detailed line drawing of the apparatus of FIG. 15 during a next stage of operation.

FIG. 17 shows a device according to another embodiment Attachment on The device Air Blast Release Detail shows the gas pressure in the initiation space 73 pushes on the valve stop 9 until the stop buffer 13 cushions and stops the movement of the valve stop 9 against the back of the barrel 8 which is the open position of the nozzle 24 and the valve rod 7 releasing the pressurized gas through a nozzle passage 75 and into the inlet flow director 100 of the attachment whereupon the gas flows though inlet flow passage(s) to an expansion space 118 behind the sabot assembly of the inner and out sabot activating the seal lip 103.

Figure 18:
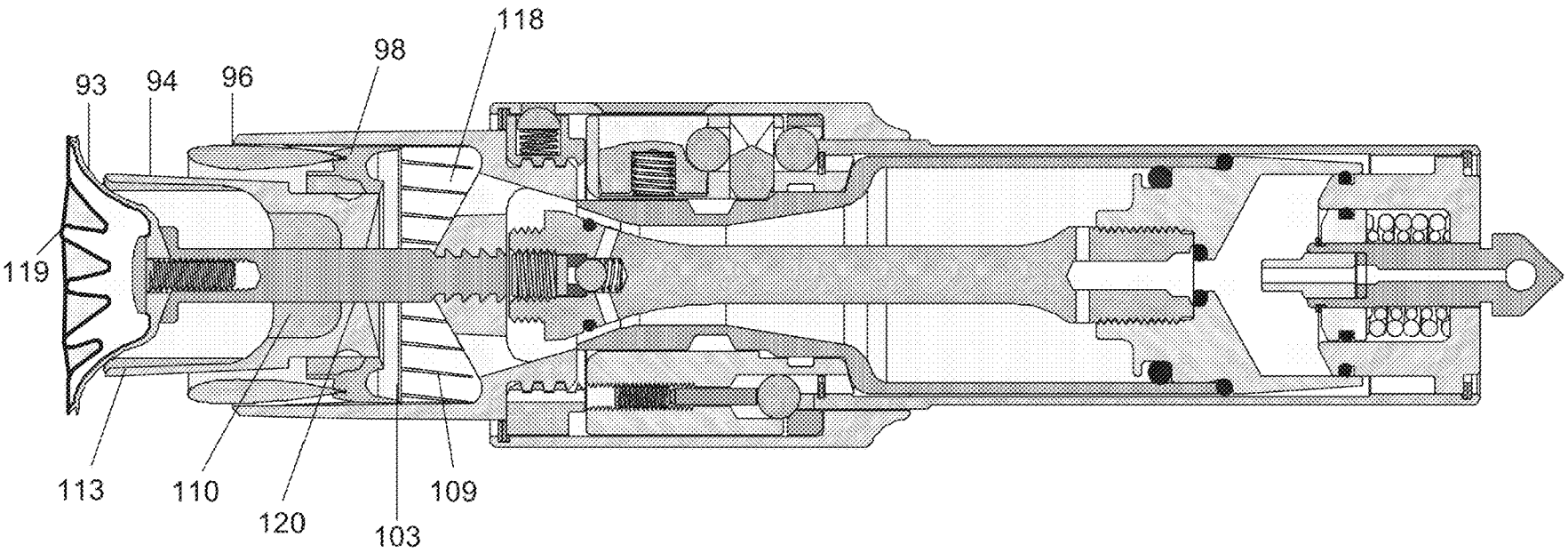
FIG. 18 shows a ULMP ring airfoil attachment on the air blast launcher start of projectile launch detailed line drawing of the apparatus of FIG. 15 during a next stage of operation.

FIG. 18 shows a device according to another embodiment Attachment on The device Start of Projectile Launch Detail shows the pressurized gas flowing from the launcher into the 118 expansions space behind the sabots of the attachment pushes the sabots forward and rotates the outer sabot 98 by pressing the seal lip 103 against the rifling 109 as the sabot moves forward. The inner sabot 94 collapses the nose cover 93 with contact with the folding ridge(s) on the forward edge of the inner sabot as it moves forward on the guide rod forming one or more folded petal 119 in the cover as it collapses into the inner sabot. This protects the projectile from contact with the cover during launch.

Figure 19:
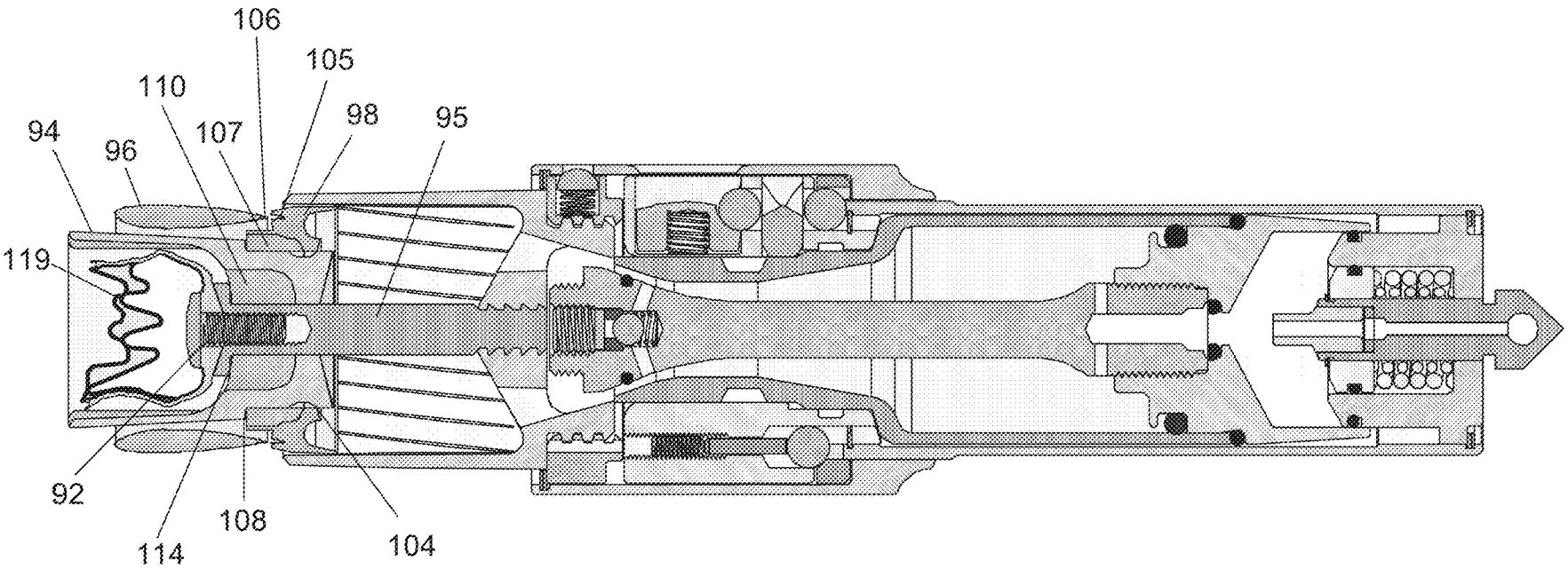
FIG. 19 shows a ULMP ring airfoil attachment on the air blast launcher projectile separation detailed line drawing of the apparatus of FIG. 15 during a next stage of operation.

FIG. 19 shows a device according to another embodiment Attachment on The device Projectile Separation Detail upon the inner sabot 94 reaching the end of its travel on the guide rod 95 and the inner sabot stop rib(s) hits up against the rod stop shoulder 114 while the outer sabot 98 in its travel on the inner sabot by the outer sabot stop rib(s) 107 hits up against the outer shop shoulder 108 on the inner sabot the ring airfoil glider projectile 96 is released by the projectile snap groove 106 and its mating surface of the projectile mount snap groove 105 on the outer sabot being overcome by the sudden shock of the outer sabot butting against the stop shoulder. The cover is fully folded forming at least one petal 119 in the inner sabot. As the outer sabot uncovers the pressure release passage 104 the pressure in the expansion space 118 starts to be released and directed by the outer sabot forward over the forward outer surface of the inner sabot.

Figure 20:
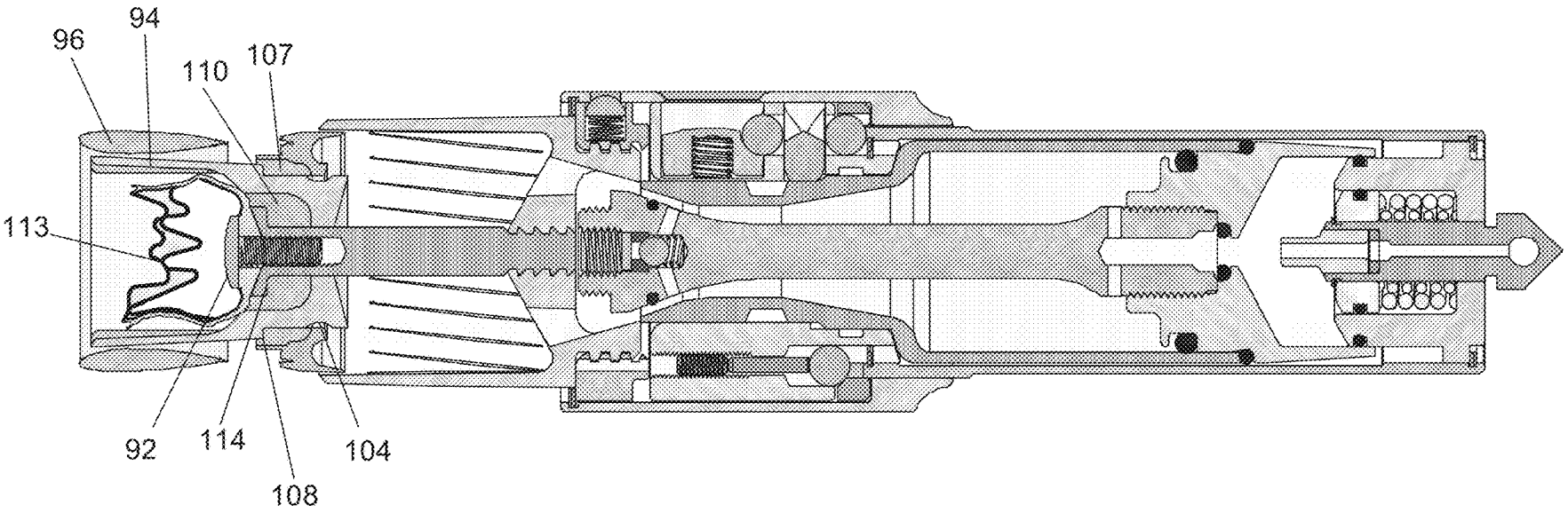
FIG. 20 shows a ULMP ring airfoil attachment on the air blast launcher stopping sabot detailed line drawing of the apparatus of FIG. 15 during a next stage of operation.

FIG. 20 shows a device according to another embodiment Attachment on The device Stopping Sabot Detail as the ring airfoil glider projectile 96 flies away the inner sabot stop rib(s) 110 crumple and decelerate the inner sabot 94 against the rod shop shoulder 114 while the outer sabot stop rib(s) crumple and decelerate the outer sabot 94 against outer sabot stop shoulder 108 on the inner sabot while continuing to vent gas through the now fully uncovered pressure release passage uncovered by the outer sabot on the inner sabot while the folded petal(s) 119 of the cover also help to decelerate the inner sabot.

Figure 21:
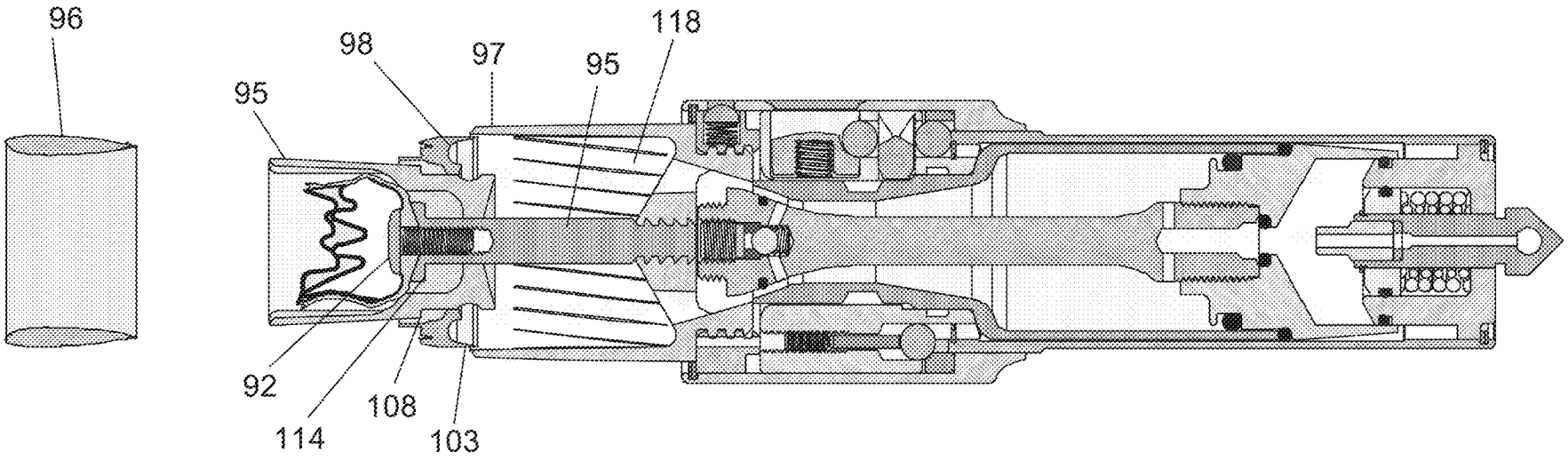
FIG. 21 shows a ULMP ring airfoil attachment on the air blast launcher projectile in flight detailed line drawing of the apparatus of FIG. 15 during a next stage of operation.

FIG. 21 shows a device according to another embodiment Attachment on The device Projectile in Flight Detail shows the ring airfoil glider projectile 96 in flight down range of the launching mechanism and the inner sabot 95 at rest on the guide rod 95 up against the rod stop shoulder 114; the cover is retained by the stop screw 92; the outer sabot 98 is retained by the outer sabot stop shoulder 108 on the inner sabot and the seal lip 103 of the outer sabot is stopped preferably inside the 97 mounting case or near the cases terminus and the expansion space 118 is fully vented of residual gas pressure.

Various aspects of different embodiments of the present invention are expressed in paragraphs X1, X2, X3, X4, and X5 as follows:

X1. One aspect of the present invention pertains to a non-lethal weapon. The weapon preferably includes a pressurized assembly including a pressure vessel, a first plug, and a second plug located at least in part within the pressure vessel and attached to the first plug. The weapon preferably includes that the pressure vessel has a distal opening and a proximal opening and a first chamber therebetween adapted and configured to hold therein gas under pressure; the first plug having a forward end that slidingly couples to the proximal opening of the proximal end of the pressure vessel, the first plug being slidable relative to the pressure vessel between first and second positions; the second plug having a forward end that seals with the opening of the distal end of the pressure vessel in the first position and also attaches to the first plug. The first or second plug includes a passageway that provides fluid communication from the first chamber to aft of the first plug. The application of gas pressure from the first chamber through the passageway to the second chamber pushes the first plug and the second plug to the second position relative to the pressure vessel, and in the second position the forward end of the second plug moves out of sealing with the first opening and permits the release of the pressurized gas from the first opening.

X2. Another aspect of the present invention pertains to a non-lethal weapon. The weapon preferable includes a pressurized assembly including a pressure vessel, a separable first plug, and a separable second plug, the second plug being located at least in part within the pressure vessel and attached to the first plug. The weapon preferably includes an actuatable trigger mechanism for the hand of a user, the trigger being adapted and configured to permit movement of the pressurized assembly relative to the trigger between a safe location and a firing location, the trigger mechanism being actuatable between a safe position restraining the movement of the pressurized assembly and a firing position permitting the movement of the pressurized assembly. The weapon preferably includes the pressure vessel having a distal end with a first opening and a proximal end with a second opening and a first chamber therebetween adapted and configured to hold therein gas under pressure. The first plug has a forward end that sealingly couples to the opening of the proximal end of the pressure vessel and an aft end, the aft end including a passageway providing fluid communication from the first chamber to the exterior of the first plug. The second plug has a forward end that seals with the opening of the distal end of the pressure vessel in the first position and an aft end that attaches to the first plug. The weapon preferably includes means for biasing the pressurized assembly from the safe location to the firing location; the biasing means being at least one of gas pressure or a spring.

X3. Yet another aspect of the present invention pertains to a non-lethal weapon. The weapon preferably includes a pressurized assembly including a pressure vessel defining a chamber adapted and configured to hold therein gas under pressure and having an aperture, and a separable plug sealingly received in the aperture, the plug being movable relative to the pressure vessel between sealed and unsealed locations. The weapon preferably includes an actuatable trigger mechanism adapted and configured for the hand of a user, the trigger mechanism being actuatable between a safe position maintaining the plug in a sealing location and a firing position permitting the plug to move to an unsealed location. The weapon preferably includes an outer nozzle member having an inner surface. The weapon preferably includes an inner nozzle member having an outer surface. The inner member is located within the outer member, the inner surface and the outer surface coacting to form a gaspath; wherein the plug moves forward from the sealed location to the unsealed location when the trigger mechanism is actuated to the firing position and releases gas from the pressure vessel to flow between the inner member and the outer member.

X4. Another embodiment of the present invention pertains to a non-lethal weapon. The weapon preferably includes a pressurized assembly including a pressure vessel defining a chamber adapted and configured to hold therein gas under pressure and having an aperture, and a separable plug sealingly received in the aperture, the plug being movable relative to the pressure vessel between sealed and unsealed locations. The weapon preferably includes an actuatable trigger mechanism adapted and configured for the hand of a user, the trigger mechanism being actuatable between a safe position and a firing position. The weapon includes a threaded fitting located in front of the plug. The weapon preferably includes a container having a threaded inlet and defining a volume for holding a supply of liquid, the threaded inlet of the container being threadably connected to the threaded fitting of the handle; wherein the plug moves forward from the sealed location to the unsealed location when the trigger mechanism is actuated to the firing position and releases gas from the pressure vessel to flow into the volume.

X5. Yet another aspect of the present invention pertains to a non-lethal weapon. The weapon preferably includes a pressurized assembly including a pressure vessel defining a chamber adapted and configured to hold therein gas under pressure and having an aperture, and a separable plug sealingly received in the aperture, the plug being movable relative to the pressure vessel between sealed and unsealed locations. The weapon preferably includes an actuatable trigger mechanism. The weapon supports a housing containing a munition supported by a pressure-actuated sabot, the sabot being slidably actuatable within the housing from a storage position to a launched position; wherein the plug moves forward from the sealed location to the unsealed location when the trigger mechanism is actuated to the firing position and releases gas from the pressure vessel to actuate the sabot and the sabot launches the munition.

Yet other embodiments pertain to any of the previous statements X1, X2, X3, X4, or X5 which are combined with one or more of the following other aspects. It is also understood that any of the aforementioned X paragraphs include listings of individual features that can be combined with individual features of other X paragraphs.

Wherein the forward end of the second plug projects a forward surface area, and the forward end of the first plug projects an aft surface area, and the aft surface area is greater than the forward surface area.

Wherein the forward end of the second plug abuts the distal end of the pressure vessel, the second plug being placed in tension when the first chamber is pressurized and the first plug and the second plug are in the first position.

Wherein the pressurized assembly is slidable relative to the handle between a safe location and a firing location.

Wherein in the second position the forward end and the first opening form a nozzle having an increasing cross-sectional area in the direction of gas flow.

Wherein the forward end is conically shaped and the first opening has a complimentary conical shape.

Wherein the pressure vessel and the first plug are slidable in the first position as a unit relative to the handle.

Wherein the aft end of the second plug is threadably coupled to the first plug. Wherein the gas is pressurized to more than 200 psig at standard temperature and pressure conditions.

Wherein the biasing means moves the pressurized assembly from the safe location toward the firing location when the trigger mechanism is actuated to the firing position.

Which further comprises a third plug supported by the handle and being sealingly engaged with the passageway when the pressurized assembly is in the safe location.

Wherein movement of the pressurized assembly to toward the firing location moves the third plug out of sealing engagement.

Wherein the trigger mechanism includes a movable travel stop, and the pressurized assembly including an exterior feature that abuts the travel stop in the safe position.

Wherein the exterior feature is a groove.

Wherein the exterior feature is a shoulder.

Wherein the biasing means is gas pressure.

Wherein the gas pressure is provided from the first chamber.

Wherein the biasing means is a spring.

Wherein the first plug is slidable relative to the pressure vessel.

Wherein at least one of the outer member or the inner member includes a distally located sharp lip that protrudes into the gas path.

Which further comprises at least one elastomeric band surrounding the outer surface of the inner member, the band flying off of the inner member upon the release of gas.

Wherein the inner surface of the outer nozzle member includes a sharp lip that protrudes into the gaspath.

Wherein the outer member has a front face, and the sharp lip is located proximate the front face and aft of the front face.

Wherein the pressure vessel is axisymmetric, and the axes of the pressure vessel, the outer member, and the inner member coincide.

Wherein in the unsealed location the plug and the aperture coact to create a divergent nozzle.

Wherein the inner surface and the outer surface coact to create a divergent nozzle.

Wherein the pressure vessel, the plug, the inner member, and the outer member are concentric about the same centerline.

Wherein the movement of the plug is axial movement.

Wherein the inner member has a front face, the outer member has a front face, and the front face of the inner member is aft of the front face of the outer member in the sealed location.

Wherein the front face of the inner member is forward of the front face of the outer member in the unsealed location.

Wherein the inner surface is conically divergent in the direction of gas flow.

Wherein the outer surface is conically divergent in the direction of gas flow, and the divergence angle of the outer surface is less than the divergence angle of the inner surface.

Wherein the outer surface is conically divergent in the direction of gas flow

Wherein the plug includes a check valve for refilling the first chamber.

Wherein the outer surface of the inner nozzle member includes a sharp lip that protrudes into the gaspath.

Wherein the inner member has a front face, and the sharp lip located proximate the front face and aft of the front face.

Wherein the handle includes a generally cylindrical outer surface, the volume is a cylindrically shaped open volume adapted and configured to receive therein a cylindrical closed volume bottle having a second inlet, the second inlet being in fluid communication with the threaded inlet.

Wherein the container is supported by a gripping handle.

Wherein the container is supported by a shoulder stock for reacting the firing load of the weapon against the body of the user.

Wherein the volume is a closed volume and the container is a plastic bottle.

Wherein the volume is a closed volume and the release of gas into the closed volume ruptures the container.

Wherein the volume is a closed volume and the container includes a check valve on a side of the container generally opposite of the threaded inlet, and the release of gas into the closed volume causes the check valve to open and release the water from the closed volume.

Wherein the gas flows between the plug and the aperture.

Wherein the threaded fitting of the handle includes internal threads.

Which further comprises a seal spanning the annular interface between the plug and the aperture, the seal preventing flow of water into the chamber, the seal permitting the release of gas from the aperture.

Which further comprises a replaceable frangible seal, the seal preventing flow of water into the chamber when the trigger mechanism is in the safe position, the seal rupturing from contact with the plug when the trigger mechanism is actuated to the firing position.

Which further comprises a movable seal, the seal preventing flow of water into the chamber when the trigger mechanism is in the safe position, the seal moving to permit the release of gas from the aperture when the plug moves to the unsealed location.

Wherein the munition is a ring airfoil.

Wherein the sabot is a first sabot in contact with the aft end of the munition, the munition includes an open interior, and wherein the housing contains a second pressure-actuated sabot supported within the open interior and being slidable from a storage position to a launched position and the release gas from the pressure vessel to actuates the second sabot.

wherein the first sabot is slidably guided by the second sabot, and the second sabot includes a stop to limit the sliding motion of the first sabot.

which further comprises a frangible cap covering the distal end of the housing, wherein in the launched position the second sabot contacts and ruptures the cap to release the munition from the housing.

Wherein the container for liquid is a plastic water bottle, and which further comprises a close fitting sleeve extending along most of the length of the bottle, but not covering the forward end of the bottle (as installed on the weapon, otherwise the bottom of the bottle).

The invention claimed is:

1. A non-lethal weapon, comprising:

a pressurized assembly including a pressure vessel, a separable first plug, and a separable second plug, said second plug being located at least in part within said pressure vessel and attached to said first plug;

a handle with an actuatable trigger mechanism for the hand of a user, said handle being adapted and configured to permit travel of said pressurized assembly relative to said handle between a safe location and a firing location, said trigger mechanism being actuatable between a safe position restraining the travel of said pressurized assembly and a firing position permitting the travel of said pressurized assembly;

said pressure vessel having a distal end with a first opening and a proximal end with a second opening and a first chamber therebetween adapted and configured to hold therein gas under pressure;

said first plug having a forward end that sealingly couples to the opening of the proximal end of said pressure vessel and an aft end, the aft end including a passageway providing fluid communication from the first chamber to the exterior of said first plug;

said second plug having a forward end that seals with the opening of the distal end of said pressure vessel in the first position and an aft end that attaches to said first plug; and further comprising:

means for biasing said pressurized assembly from the safe location to the firing location, wherein said biasing means moves said pressurized assembly from the safe location toward the firing location when said trigger mechanism is actuated to the firing position.

2. The weapon of claim 1 which further comprises a third plug supported by said handle and being sealingly engaged with the passageway when said pressurized assembly is in the safe location.

3. The weapon of claim 2 wherein movement of said pressurized assembly toward the firing location moves the third plug out of sealing engagement.

4. The weapon of claim 1 wherein said trigger mechanism includes a movable travel stop, and said pressurized assembly including an exterior feature that abuts said travel stop in the safe position.

5. The weapon of claim 1 which further comprises an axisymmetric nozzle for expelling the gas to ambient conditions.

6. The weapon of claim 5 wherein the nozzle includes a cross sectional area that increases in the direction of gas flow.

7. The weapon of claim 5 wherein said nozzle includes generally smooth inner and outer surfaces, and at least one of the inner or outer surfaces includes a distally located sharp lip that protrudes into the gas path.

8. The weapon of claim 1 wherein the forward end is conically shaped and the first opening has a complementary conical shape.

9. The weapon of claim 1 wherein the forward end of said second plug projects a forward surface area, and the forward end of said first plug projects an aft surface area, and the aft surface area is greater than the forward surface area.

10. The weapon of claim 1 which further comprises a divergent nozzle that expels pressurized gas to ambient conditions.

11. The weapon of claim 10 wherein the nozzle includes a sharp lip that protrudes into the gaspath.

12. The weapon of claim 1 which further comprises a nozzle for expelling pressurized gas to ambient conditions, said nozzle having an annular gaspath.

13. The weapon of claim 1, wherein said biasing means includes gas pressure.

* * * * *